US007102964B2

(12) United States Patent
Fujisawa

(10) Patent No.: US 7,102,964 B2
(45) **Date of Patent: *Sep. 5, 2006**

(54) TIME KEEPING APPARATUS AND CONTROL METHOD THEREFOR

(75) Inventor: Teruhiko Fujisawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 124 days.

This patent is subject to a terminal disclaimer.

(21) Appl. No.: 10/851,435

(22) Filed: May 21, 2004

(65) Prior Publication Data

US 2004/0246821 A1 Dec. 9, 2004

Related U.S. Application Data

(63) Continuation-in-part of application No. 10/652,368, filed on Aug. 29, 2003, now abandoned, which is a continuation of application No. 09/780,143, filed on Feb. 9, 2001, now Pat. No. 6,643,223.

(51) Int. Cl.
*G04C 23/00* (2006.01)

(52) U.S. Cl. ..... 368/66; 368/204; 368/205; 368/47

(58) Field of Classification Search ..... 368/204, 368/203, 205, 66, 47
See application file for complete search history.

(56) References Cited

U.S. PATENT DOCUMENTS 5,889,736 A * 3/1999 Fujita et al. ..... 368/66
6,172,943 B1 * 1/2001 Yuzuki ..... 368/204
6,320,822 B1 11/2001 Okeya et al.
6,424,600 B1 7/2002 Okeya et al.
6,476,580 B1 11/2002 Nakamiya et al.
6,483,781 B1 11/2002 Igarashi et al.
6,563,766 B1 5/2003 Nakamiya

FOREIGN PATENT DOCUMENTS

| | | |
|---|---|---|
| DE | 44 24 337 A1 | 1/1996 |
| EP | 0 935 178 A2 | 8/1999 |
| JP | 11-223684 | 8/1999 |
| WO | WO 97/21153 | 6/1997 |
| WO | WO 99/27423 | 6/1999 |

* cited by examiner

*Primary Examiner*—Randy W. Gibson
*Assistant Examiner*—Sean Kayes
(74) *Attorney, Agent, or Firm*—Mark P. Watson

(57) ABSTRACT

When a time keeping apparatus is in a power saving mode, performing time display is stopped, and the apparatus periodically receives a time data from outside and sets the data to a second time counter 98 and an hour-and-minute time counter 99. When the operation mode of the time keeping apparatus is switched from the power saving mode to the display mode, the apparatus resumes to display the current time based on the counted values in the second time counter 98 and the hour and minute time counter 99.

25 Claims, 17 Drawing Sheets

TIME KEEPING APPARATUS AND CONTROL METHOD THEREFOR

CONTINUING APPLICATION DATA

This application is a continuation-in-part of U.S. patent application Ser. No. 10/652,368 filed Aug. 29, 2003 now abandoned, which is a continuation of U.S. patent application Ser. No. 09/780,143 filed Feb. 9, 2001, now U.S. Pat. No. 6,643,223, the contents of each of which are incorporated herein by reference in their entirety.

BACKGROUND OF THE INVENTION

1. Field of the Invention

The present invention relates to a time keeping apparatus and a control method for it, more particularly to a radio-controlled timepiece having a power saving function to reduce its power consumption.

2. Description of the Related Art

A radio-controlled watch that has a power saving function and receives time data from the outside and adjusts the time is disclosed in Japanese Patent Application Laid Open Publication No. 11-223684 entitled "radio-controlled watch". The radio-controlled watch has a thermoelectric generator that generates electricity by using temperature difference between the wearer's arm and outside air. The watch stores the electricity in its storage unit and uses the electricity to operate.

The radio-controlled watch periodically receives a standard time radio signal by the Communications Research Laboratory (CRL) of Japan that is transmitted at a frequency of 40 kHz under a call sign of JJY (its former call sign was JG2AS). In the radio wave, time data is superimposed, and one set of the time data has a length of 60 seconds. The time data has data of current hour, current minute, and current day which shows the number of days from January first of that year. Based on the time data, the time of the watch is adjusted.

However, the radio-controlled watch has a problem. The problem is that when a user wears the watch that is left unused for a long time, the user cannot know the correct time for several minutes. This is because the time adjustment of the watch is conducted only after the watch receives several sets of the time data. This is also because there are cases where the watch does not conduct a time adjustment, but continues to perform a time display: one case of them is when the battery voltage declines below a certain voltage where time display can become incorrect.

SUMMARY OF THE INVENTION

Accordingly, an object of the present invention is to provide a time keeping apparatus and a control method for it, by which the user can know the current time more quickly and precisely when the operation mode of the apparatus is switched from the power saving mode to the normal operation mode.

According to one aspect of the present invention, an object of the present invention is achieved by a time keeping apparatus comprising: a generator unit for generating electricity using external energy; a battery unit for storing the electricity; a time display unit for displaying time by using the electricity supplied from the battery unit; a generation state detecting unit for checking an operation state of the generator unit and for outputting a detected generation state signal; a mode switching unit for switching an operation mode between a normal operation mode in which the time display operation is performed based on the detected generation state signal and a power saving mode in which the time display operation is stopped; a receiver unit for receiving time information during the normal operation mode and the power saving mode; and a current time counting unit for renewing current time information by referring to the time which corresponds to the time information received by the receiver unit, and wherein the mode switching unit switches the operation mode from the normal operation mode to the power saving mode when the state of the generator unit is detected in a non-generation state on the basis of the detected generation state signal.

According to another aspect of the present invention, an object of the present invention is achieved by a time keeping apparatus comprising: a battery unit for storing electricity, a time display unit for performing a time display by using the electricity supplied from the battery unit; a carry-state detecting unit for detecting a carry-state of the time keeping apparatus and for outputting a detected carry-state signal; a mode switching unit for switching an operation mode of the time display unit between a normal operation mode in which the time display is performed and a power saving mode in which the time display is stopped based on the detected carry-state signal, a receiver unit for receiving time information during the normal operation mode and the power saving mode; and a current time counting unit for renewing current time information by referring to the time which corresponds to the time information received by the receiver unit, and wherein the mode switching unit switches the operation mode from the normal operation mode to the power saving mode when the state of the generator unit is detected to be in a non-generation state on the basis of the detected generation state signal.

According to another aspect of the present invention, an object of the present invention is achieved by a method for controlling a time keeping apparatus which comprises a generator unit for generating electricity by converting external energy to electrical energy and a time display unit for performing a time display, the method for controlling the time keeping apparatus comprising: detecting an operation state of the generator unit and outputting a detected generation state signal; in response to the detected generation state signal, switching an operation mode of the time display unit between a normal operation mode in which the time display is performed and a power saving mode in which the time display is stopped; receiving external time information during the normal operation mode and the power saving mode; updating a current time information that corresponds to the current time by referring to the received external time information; and; responsive to the detected generation state signal, switching the operation mode from the normal operation mode to the power saving mode when the state of the generator unit is detected to be in a non-generation state.

According to another aspect of the present invention, an object of the present invention is achieved by a method for controlling a time keeping apparatus that comprises a time display unit that performs a time display, the method comprising: detecting a carry-state of the time keeping apparatus and outputting a detected carry-state signal; in response to the detected carry-state signal, switching an operation mode of the time display unit between a normal operation mode in which the time display is performed and a power saving mode in which the time display is stopped; receiving external time information during the normal operation mode and the power saving mode; updating a current time information that corresponds to the current time by referring to the received external time information; and responsive to the detected carry-state signal, switching the operation mode from the normal operation mode to the power saving mode when the state of the time keeping apparatus is detected to be in a non-carried state.

DESCRIPTION OF THE PREFERRED EMBODIMENTS

[1] First Embodiment

[1.1] Configuration of the First Embodiment

Figure 1:
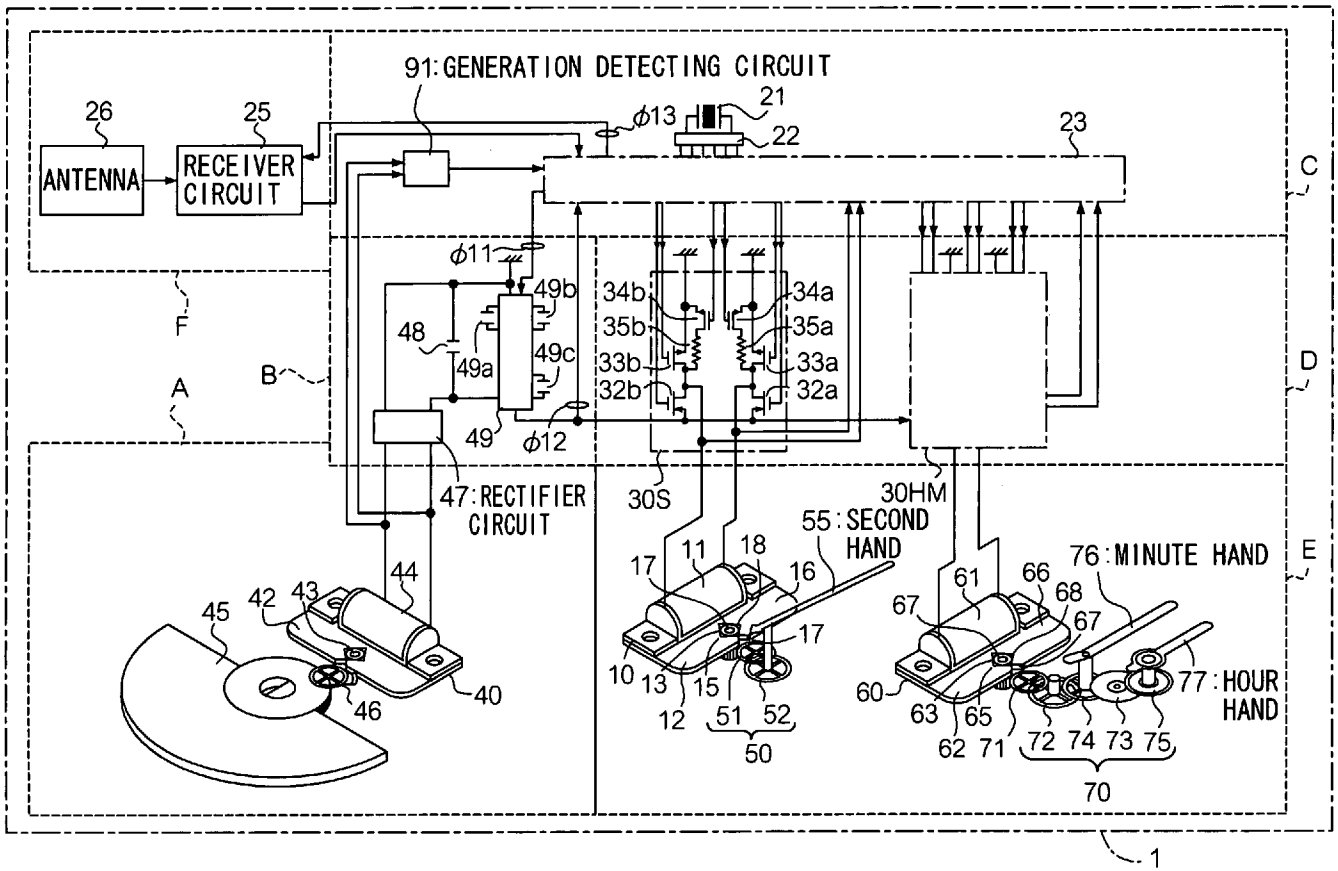
FIG. 1 shows a schematic configuration of a time keeping apparatus of the present invention.

Referring to the drawings, a first embodiment of the present invention will be described. FIG. 1 shows a schematic configuration of a time keeping apparatus 1 according to the first embodiment of the present invention. The apparatus 1 is a wristwatch used with a belt connected to the watch body. A user winds the belt around one's own wrist.

The time keeping apparatus 1 essentially includes a power generation unit A for generating alternating current; a power source unit B for rectifying and boosting the alternating voltage from the power generation unit A, for storing the electricity, and for supplying each component with the power; a controller unit C for detecting a generation state of the power generation unit A and for controlling the apparatus based on the detected result; a hand drive mechanism E for moving hands by using an hour-and-minute motor 60 and a second motor 10; a drive unit D for driving the hand drive mechanism E based on a control signal provided from the controller unit C; and a receiver unit F for receiving radio wave coming from the outside.

Each component of the apparatus will be described next.

[1.1.1] Configuration of a Generator Unit

The power generator unit A comprises a generating device 40, an oscillating weight 45, and a speed increasing gear 46. The generating device 40 is an electromagnetic induction type AC generator, and comprises a rotor 43, a stator 42, and a coil 44. The rotor 43 is connected via the speed increasing gear 46 to the oscillating weight 45.

The oscillating weight 45 is configured to swing in response to user's arm's motion. The kinetic energy of the oscillating weight 45 is transmitted to the rotor 43 via the speed increasing gear 46. By this, the rotor 43 rotates in the stator 42 and a voltage is induced across the coil 44. The induced voltage is output to two output terminals of the coil 44. In this way, electricity is generated by making use of the energy relating to the user's living activity, and the time keeping apparatus 1 is driven by using this electricity.

[1.1.2] Configuration of a Power Supply Unit

The power source unit B is essentially composed of a rectifier circuit 47, a large capacitance battery 48, and a voltage boost and drop circuit 49. The voltage boost and drop circuit 49 uses several capacitors 49*a*, 49*b* and 49*c* to implement a multistage voltage boost and drop. By this and in response to a control signal Φ 11 given from the controller unit C, a voltage supplied to the drive unit D can be adjusted. In addition, an output voltage of the voltage boost and drop circuit 49 is supplied to the controller unit C by a monitor signal Φ 12, so the output voltage is monitored. However, instead of this configuration of supplying the output voltage of the circuit 49 to the controller unit C, another configuration of supplying a voltage signal of the battery 48 to the controller unit C is possible. The power source unit B outputs voltage between its two output terminals. One terminal having a higher electrical potential Vdd is fixed to a referential electrical potential GND. The other terminal having a lower electrical potential Vss supplies a power source voltage.

[1.1.3] Configuration of a Hand Drive Mechanism

The hand drive mechanism E comprises a second motor 10 and an hour-and-minute motor 60. The second motor 10 drives a second hand 55. The hour-and-minute motor 60 drives an hour hand 77 and a minute a hand 76. As motors for the motors 60 and 10, stepping motors are used. The stepping motor is also referred to as a pulse motor, a step motor, or a digital motor, and is driven with a pulse signal and is used widely as an actuator for digital controlled apparatus. In recent years, compact and lightweight stepping motors are widely used as actuators for compact and portable electronic devices or information devices. Among these electronic devices is time keeping apparatus such as electronic clocks, electronic time switches, and chronographs.

The second motor 10 comprises a coil 11, a stator 12, and a rotor 13. Driving pulses provided from the drive unit D produce magnetic field across the coil 11. The stator 12 has two functions, one is for fixing the motor, and the other is as an electromagnet excited by the coil 11. The rotor 13 rotates by the magnetic field in the stator 12.

The hour-and-minute motor 60 has a similar configuration to that of the second motor 10. The motor 60 comprises a coil 61, a stator 62, and a rotor 63. Driving pulses supplied from the drive unit D produce magnetic field across the coil 61. The stator 62 has two functions, one is for fixing the motor, and the other is as an electromagnet excited by the coil 61. The rotor 63 rotates by the magnetic field in the stator 62.

Rotation of the rotor 13 is transmitted to the second hand by way of a second gear train 50 consisting of a second intermediate wheel 51 engaged with the rotor 13 via a pinion, and a second wheel 52. Attached to the shaft of the second wheel 52 is the second hand 55. Rotation of the rotor 63 is transmitted to the hour hand and the minute hand by way of a hour-and-minute gear train 70 consisting of a fourth wheel 71 engaged with the rotor 63 via a pinion, a third wheel 72, a center wheel 73, a minute wheel 74, and an hour wheel 75. The center wheel 73 is connected to a minute hand 76, and the hour wheel 75 to an hour hand 77. Hence, these hands 55, 76, and 77 display the time by the rotations of rotors 63 and 13.

[1.1.4] Configuration of a Drive Unit

The drive unit D comprises a second drive circuit 30S and an hour-and-minute drive circuit 30HM. The drive unit D provides the hour-and-minute motor 60 and the second motor 10 with various driving pulses under the control of the control unit C.

[1.1.5] Configuration of a Receiver Unit

The receiver unit F comprises a ferrite rod antenna 26, a receiver circuit 25, and a storage circuit (not shown in figures) for storing time information. The antenna 26 receives radio waves including standard time radio signal, for example JJY broadcast at a frequency of 40 kHz by the Communications Research Laboratory (CRL) of Japan. The receiver circuit 25 tunes in to receive the standard time radio signal and outputs time data. The storage circuit stores the time data.

Figure 4:
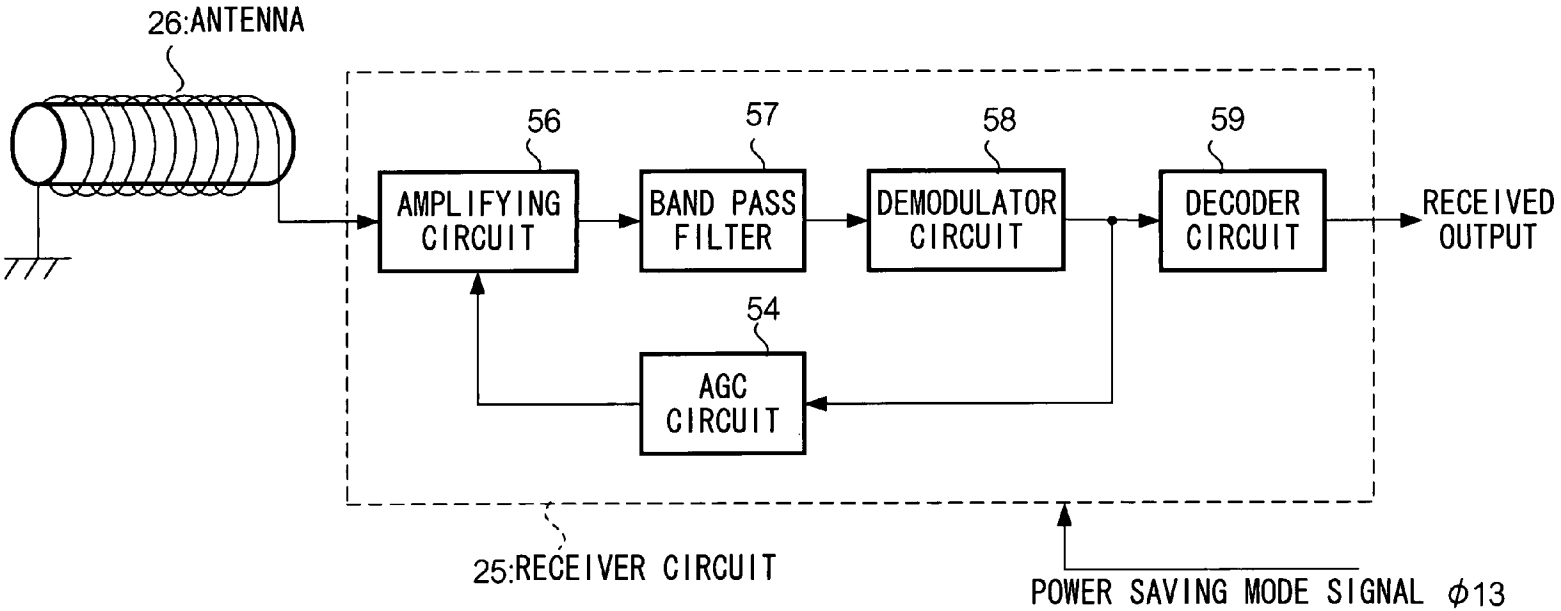
FIG. 4 is a block diagram showing a configuration of a receiver circuit.

With reference to FIG. 4, the detailed configuration of the receiver circuit 25 will be described. The receiver circuit 25 comprises an Automatic Gain Control (AGC) circuit 54, an amplifying circuit 56, a band pass filter 57, a demodulator circuit 58, and a decoder circuit 59.

The radio wave received by the antenna 26 enters the amplifying circuit 56. The amplifying circuit 56 amplifies the radio signal under a gain control by the AGC circuit 54 and outputs it to the band pass filter 57. The band pass filter 57 selects a radio signal with a target frequency from the radio wave and outputs it to the demodulator circuit 58. The demodulator circuit 58 smoothes the selected radio wave, demodulates it, and outputs it to the decoder circuit 59. The decoder circuit 59 decodes the demodulated signal and outputs it as a received output signal.

In this process, the AGC circuit 54 controls the gain of the amplifying circuit 56 based on the output signal of the demodulator circuit 58 to make the output level of the standard time radio wave constant. The power saving mode signal Φ 13 shown in FIG. 4 is supplied from a controller circuit 23 shown in FIG. 1 and controls on/off of the receiving operation of the receiver circuit 25. In more concrete explanation, when the power saving mode signal Φ 13 has the high level, the receiver circuit 25 carries out the receiving operation, and when the power saving mode signal has the low level, the receiver circuit 25 does not carry out the receiving operation, which is for lowering the power consumption of the circuit 25.

In the display mode which corresponds to the normal operation mode, the receiver circuit 25 is controlled by the power saving mode signal Φ 13 to carry out a receiving operation in a prescribed cycle (for example in a cycle of one day). When the time data is not received correctly, the receiving operation will be carried out more than once.

On the other hand in the power saving mode, the circuit 25 is controlled by the signal Φ 13 to carry out a receiving operation in another cycle which is longer than that in the display mode (for example, in a cycle of several days). The reason of this is to reduce the power consumption during the power saving operation, since the receiving operation requires electric current of 30 to 40 micro amperes which is about 100 to 200 times more than that in the normal operation mode.

Here, with reference to FIGS. 9 and 10, the standard time radio signal by the CRL of Japan will be described. The standard time radio signal has an incorporated time data in it with a format shown in FIG. 9. The time code format shown in FIG. 9 will be described. The time code has sixty segments. For each segment, one signal is transmitted. It takes one second to transmit one signal. Sixty signals (one minute) compose one set of time data. Each signal transmitted from the CRL has any one of three types, "1", "0", and "P".

Figure 10:
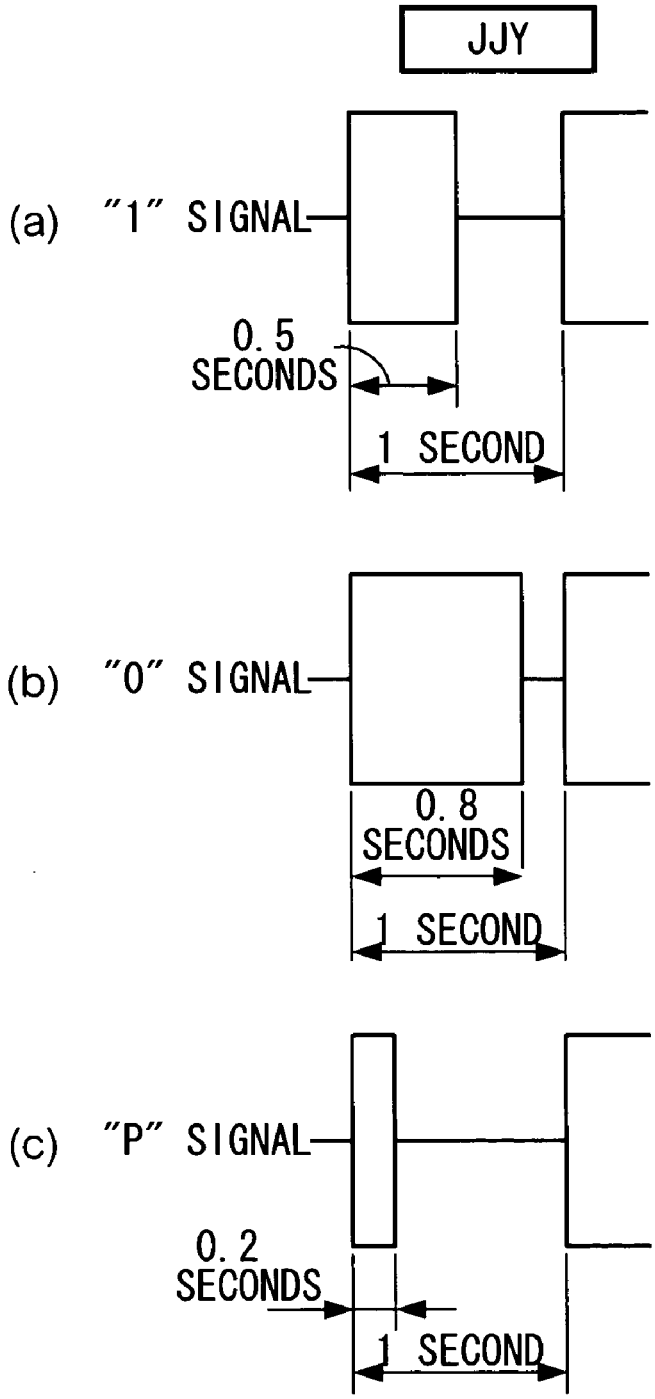
FIG. 10 is a diagram explaining the signals by the CRL.

Types of the signals are identified by the duty factor of each signal shown in FIG. 10. Part (a) of FIG. 10 shows a signal wave form representing "1" with large amplitude lasting 0.5 seconds (duty factor 50). Part (b) of FIG. 10 shows a pulse form representing "0" with large amplitude lasting 0.8 seconds (duty factor 80). Part (c) of FIG. 10 shows a pulse form representing "P" with large amplitude lasting 0.2 seconds (duty factor 20).

Figure 9:
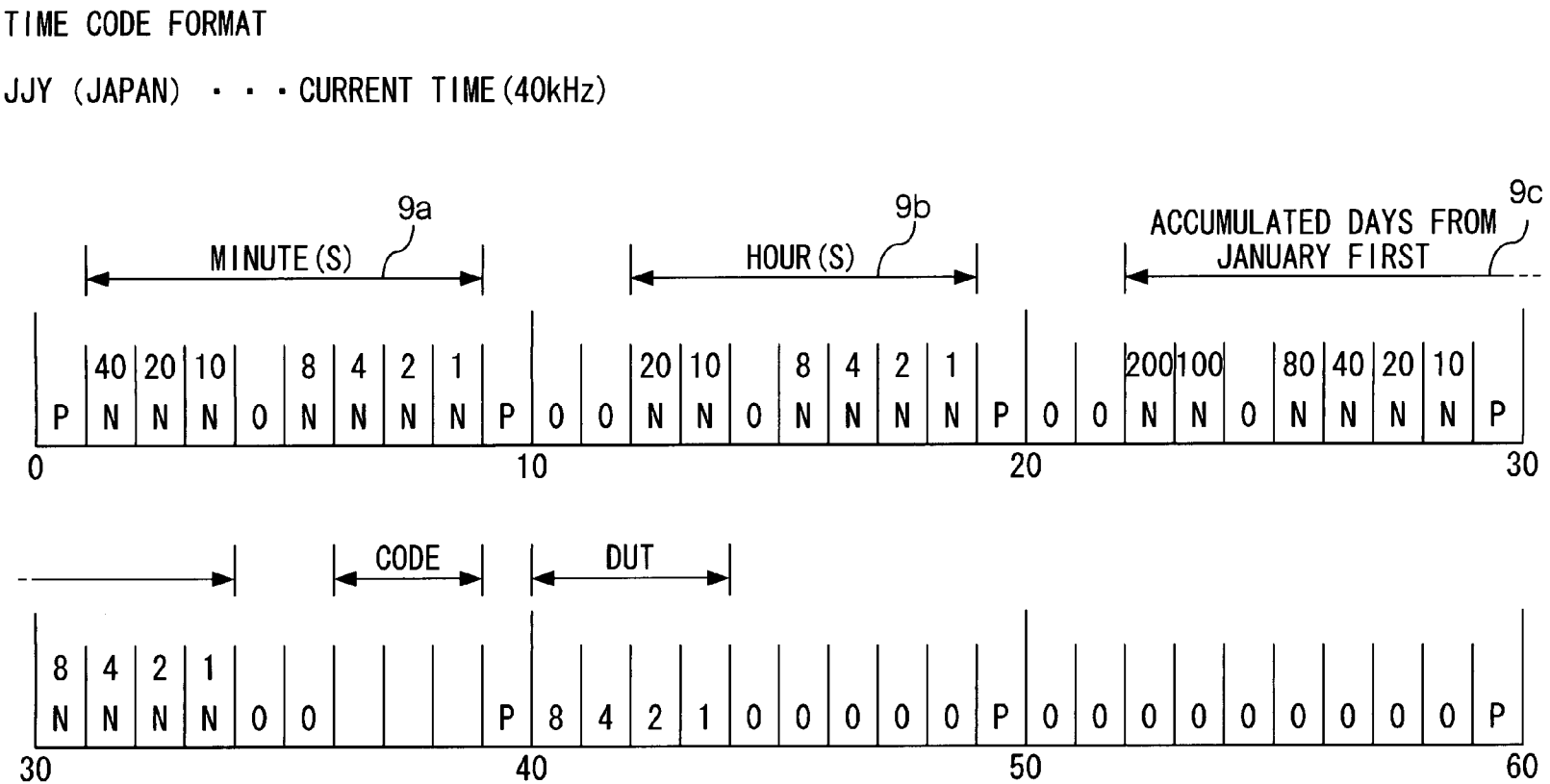
FIG. 9 shows the timecode format of the standard time radio signal by the Communications Research Laboratory (CRL) of Japan.

As shown in FIG. 9, the time code format includes minute information 9*a* indicating the current minute, hour information 9*b* indicating the current hour, and day information 9*c* indicating the current day. The current day is indicated as accumulated days from January first of the year.

And the parameters "P" and "0" in the time code format in FIG. 9 are constant parameters and used for synchronization between the radio wave signal and the time code format. Two "P"s in a row means "00" sharp.

The indication "N" in the time code format in FIG. 9 means that when signal "1" is transmitted, the parameter "N" becomes the ON state and is used for adding a minute. When a signal other than 1 is transmitted, the parameter "N" becomes the OFF state and is not used for adding. The indication "N" has a weight as shown in FIG. 9 for adding. For example, when the minute information 9*a* has a data set of "1", "0", "1", "0", "0", "1", "1", "1", the current minute is, 40*1+20*0+10*1+8*0+4*1+2*1+1*1=57.

The standard time radio signal is based on a cesium atomic clock that has an accuracy of within one second per a hundred thousand years. Therefore the radio-controlled watch can also keeps time accurately.

[1.1.6] Configuration of a Controller Unit

Figure 2:
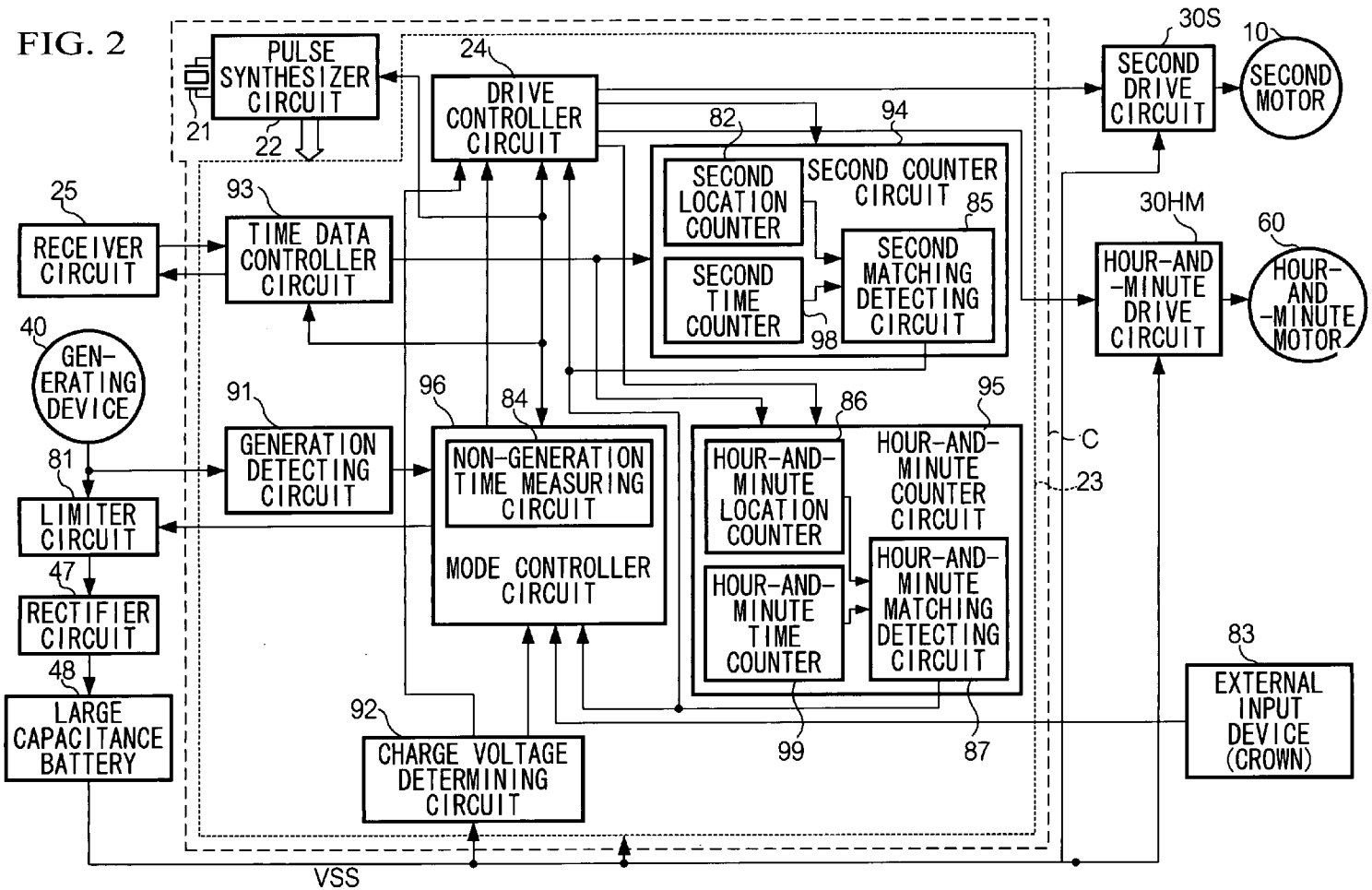
FIG. 2 is a block diagram showing a schematic configuration of a controller unit.

Referring to FIG. 2, the controller unit C and its peripheral units will be described below. FIG. 2 is a functional block diagram of the controller unit C and its peripheral units of the first embodiment of the present invention. The controller unit C comprises a pulse synthesizer circuit 22, a generation detecting circuit 91, a charge voltage determining circuit 92, a time data controller circuit 93, a second counter circuit 94, an hour-and-minute counter 95, and a mode controller circuit 96.

The charge voltage determining circuit 92 determines charge voltage of the large capacitance battery 48. The time data controller circuit 93 controls the second counter circuit 94 and the hour-and-minute counter 95 based on the output signal of the mode controller circuit 96. The circuit 93 also controls time data receiving operation by the receiver circuit 25. For the circuit 93, its configuration is not limited to hardware configuration. However, the function of the circuit 93 can be achieved by software by using a central processing unit (CPU), a read only memory (ROM), a random access memory (RAM), and other hardware.

Around the controller unit C, a limiter circuit 81 is constructed between the generating device 40 and the large capacitance battery 48. The limiter circuit 81 prevents the battery 48 from overcharging. This is because the battery 48 has its rated voltage. When the stored voltage exceeds the withstand pressure voltage, the battery becomes a state of overcharge and the quality of the battery deteriorates.

When the mode controller circuit 96 is notified by the charge voltage determining circuit 92 that the voltage of the large capacitance battery 48 exceeds a certain voltage, the limiter circuit 81 conducts its operation by a command from the mode controller circuit 96. When the circuit 81 conducts its operation, a limiter transistor (not shown in FIG. 2) becomes to the ON state and makes a by-pass in order for the charging current generated by the generating device 40 not to go into the battery 48.

However the configuration for this function is not limited to this. In this configuration, no voltage boost and drop circuit is used. However, it is possible to use the voltage boost and drop circuit. In that case, the voltage boost and drop circuit 49 in FIG. 1 can be connected to the following stage of the battery 48, so that the charge voltage determining circuit 92 determines the voltage boosted by the voltage boost and drop circuit 49. Also the limiter circuit 81 can be controlled by the charge voltage determining circuit 92 without using the mode controller circuit 96.

Each component of the controller unit C will be described below.

[1.1.6.1] Configuration of a Pulse Synthesizer Circuit

The pulse synthesizer circuit 22 will be described first. The circuit 22 comprises an oscillator circuit and a synthesizer circuit. The oscillator circuit is connected to a standard oscillation source 21 such as a quartz oscillator and outputs a standard pulse that has a constant frequency to the synthesizer circuit. The synthesizer circuit divides the frequency of the standard pulse and synthesizes the divided pulses and the standard pulse to generate pulse signals with various wave forms.

[1.1.6.2] Configuration of a Generation Detecting Circuit

Figure 5:
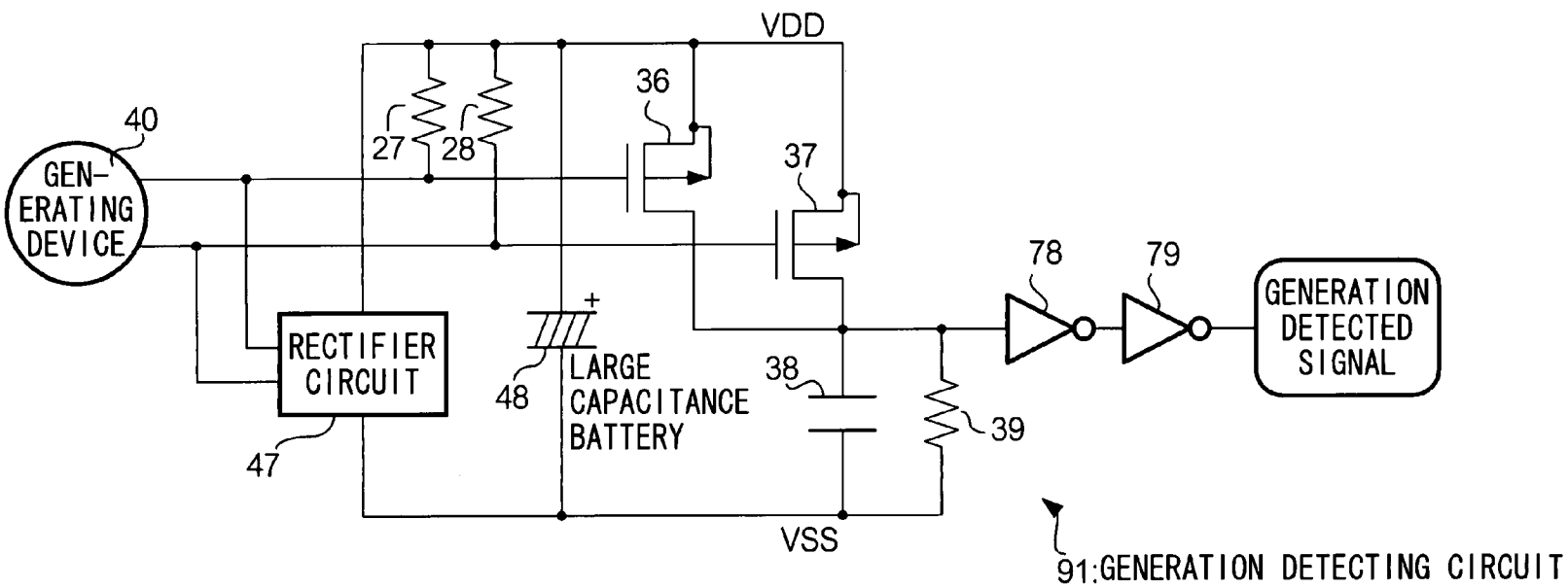
FIG. 5 is a block diagram showing a configuration of a generation detecting circuit.

With reference to FIG. 5, detailed configuration of the generation detecting circuit 91 for outputting a detected generation signal will be described. The circuit 91 shown in FIG. 5 comprises two p-channel transistors 36 and 37, a capacitor 38, a resistor 39, two inverters 78 and 79, and two pull-up resistors 27 and 28. The gate terminal of the p-channel transistor 36 is connected to one of the output terminals of the generating device 40. The gate terminal of the transistor 37 is connected to another output terminal of the device 40. The source terminals of the transistors 36 and 37 are connected to the higher electric potential side voltage Vdd line. One terminal of the capacitor 38 is connected to the drain terminals of the transistors 36 and 37. The other terminal of the capacitor 38 is connected to the lower electric potential side voltage Vss line. The resistor 39 has high resistance ranging from several tens of million ohms to several giga ohms. The resistor 39 is connected in parallel with the capacitor 38 and is used for discharging the charge in the capacitor 38. The input terminal of the inverter 78 is connected to the drain terminals of the p-channel transistors 36 and 37. The output of the inverter 78 is connected to the inverter 79. The inverter 79 outputs a detected generation signal. In this explanation, the higher electric potential side voltage Vdd (=GND) is used as a reference voltage, and the voltage Vss represents a potential difference from the voltage Vdd, and has a negative voltage.

In the above configuration, when voltage is generated by the generating device 40, the p-channel transistors 36 and 37 alternately becomes the ON state and voltage is applied between both terminals of the capacitor 38 via either transistor 36 or 37. By this, the input to the inverter 78 becomes the high level, and the detected generation signal output from the inverter 79 becomes the high level.

On the other hand, when voltage is not generated by the generating device 40, both the transistors 36 and 37 remains the OFF state. By this, the electrical charge in the capacitor 38 is discharged by the resistor 39, so the voltage between the terminals of the capacitor 38 declines and the input to the inverter 78 becomes the low level. Therefore, the detected generation signal output from the inverter 79 becomes the low level. In this configuration, the generation detecting circuit 91 has two pull-up resistors 27 and 28. Therefore, when no generation occurs in the generating device 40, it is possible to securely make the p-channel transistors 36 and 37 to the OFF state without influence of residual field. So, the power consumption by the generation detecting circuit 91 is reduced to zero. As a result, power consumption from the large capacitance battery 48 will be reduced.

[1.1.6.3] Configuration of a Mode Controller Circuit

The mode controller circuit 96 comprises a non-generation time measuring circuit 84. The circuit 84 controls switching of an operation mode including a display mode and a power saving mode for the time display based on generation state, and measures non-generation time interval Tn in which no generation is detected by the generation detecting circuit 91. The operation mode of the embodiments of the present invention has a display mode and a power saving mode. The display mode is an operation mode to continuously display time in the case of time keeping apparatus 1 of the present invention.

The power saving mode is a mode for power saving. In the power saving mode, a state of the normal operation mode just before transition to the power saving mode or a progress information of the power saving mode is stored. As a result, when switching to the normal operation mode is carried out, by using the state at the transition to the power saving mode and the progress information, transition is conducted. Therefore, in the time keeping apparatus 1 of the present invention, performing a time display is stopped, and by using the progress time in the power saving mode, when switching to the normal operation mode, correct time display can be possible.

The mode controller circuit 96 remembers the set operation mode, and provides this information to a drive controller circuit 24 and the time data controller circuit 93. When the operation mode is changed from the display mode to the power saving mode, the drive controller circuit 24 stops supplying pulse signals to the drive circuits 30HM and 30S to stop the circuits 30HM and 30S. Then the hour-and-minute motor 60 and second motor 10 stop moving, so the hour hand, the minute hand, and the second hand stop too. Hence time display is stopped.

This can be manually done by the user. When the user of the watch use a crown to conduct a switching operation to the power saving mode, the mode controller circuit 96 switches the operation mode from the display mode to the power saving mode. By this, regardless of the non-generation time Tn, it is possible to switch the operation mode to the power saving mode and to prevent the amount of the stored energy in the battery from declining.

The non-generation time measuring circuit 84 switches the operation mode from the display mode to the power saving mode when non-generation time Tn exceeds a given period of time. While the switch from the power saving mode to the display mode is conducted when the generation detecting circuit 91 detects that the generating device 40 is in the generating state, and the charge voltage determining circuit 92 determines that the battery voltage of the battery 48 is full enough.

[1.1.6.4] Configuration of a Second Counter Circuit

The second counter circuit 94 comprises a second location counter 82, a second time counter 98, and a second matching detecting circuit 85. The second location counter 82 makes one rotation in 60 seconds. When switching from the display mode to the power saving mode, the circuit 82 drives the second hand until the second location counter 82 becomes "00" (corresponding to the location of "00" second, for example). Then when the second location counter 82 becomes "00", the counter 82 stops the time display and the operation mode is switched to the power saving mode. This is because the watch cannot determine the location of the hand, and the watch determines relative location of the hand at the transition to the display mode by referring to the hand location corresponding to "00" count of the counter 82.

The second time counter 98 makes one rotation in 60 seconds. The counter 98 continues to count irrespective of the operation mode. When the receiver circuit 25 receives the time data, a counter value in the second time counter 98 is set based on the time data by the time data controller circuit. When the operation mode is switched from the power saving mode to the display mode, the second counter circuit 94 counts fast-forward pulses supplied from the drive controller circuit 24 to the second drive circuit 30S by using the second location counter 82. When the counted value of the second location counter 82 matches the counted value of the second time counter 98, the second matching detecting circuit 85 generates a control signal to stop sending the fast-forward pulses and supplies the signal to the second drive circuit 30S.

[1.1.6.5] Configuration of an Hour-and-Minute Counter Circuit

The hour-and-minute counter 95 comprises an hour-and-minute location counter 86, an hour-and-minute time counter 99, and an hour-and-minute matching detecting circuit 87. The hour-and-minute location counter 86 makes one rotation in 24 hours. In analog watches for example, when switching from the display mode to the power saving mode, the hour-and-minute location counter 86 drives the hands until the counter reaches to "00:00" or "12:00" (for example, corresponding to the location of 12 o'clock). When the hour-and-minute counter 86 reaches to "00:00" or "12:00", the counter 86 stops the time display and the operation mode is switched to the power saving mode. This is because the watch cannot determine the location of the hands, and the watch determines relative locations of the hands by referring to the location of hands corresponding to "00:00" or "12:00" count of the counter 86.

The hour-and-minute time counter 99 makes one rotation in 24 hours. The counter 99 continues to count irrespective of the operation mode. When the receiver circuit 25 receives the time data, a counter value in the hour-and minute time counter 98 is set based on the time data by the time data controller circuit. When the operation mode is switched from the power saving mode to the display mode, the hour-and-minute counter circuit 95 counts fast-forward pulses supplied from the drive controller circuit 24 to the hour-and-minute drive circuit 30HM by using the hour-and-minute location counter 86. When the counted value of the hour-and-minute location counter 86 matches the counted value of the hour-and-minute time counter 99, the hour-and-minute matching detecting circuit 87 generates a control signal to stop sending the fast-forward pulses and supplies the signal to the hour-and-minute drive circuit 30HM.

[1.1.6.6] Configuration of a Drive Controller Circuit

Based on various pulse signals output from the pulse synthesizer circuit 22, the drive controller circuit 24 generates drive pulse signals corresponding to the operation mode. First, when the operation mode is the power saving mode, the drive controller circuit 24 stops supplying drive pulse signals, resulting in stopping the drive motor. This reduces much of the power consumption of the apparatus, because about 85 percent of power consumption of the analog watch are due to the drive motor. Next, just after the operation mode is switched from the power saving mode to the display mode, the drive controller circuit 24 supplies fast-forward pulses having short pulse width to the drive circuit 30HM and 30S in order to make the redisplayed time adjusted. After finishing supplying fast-forward pulses, the circuit 24 supplies normal pulse width drive pulse signal to the circuit 30HM and 30S.

[1.2] Operation of the First Embodiment

Figure 3:
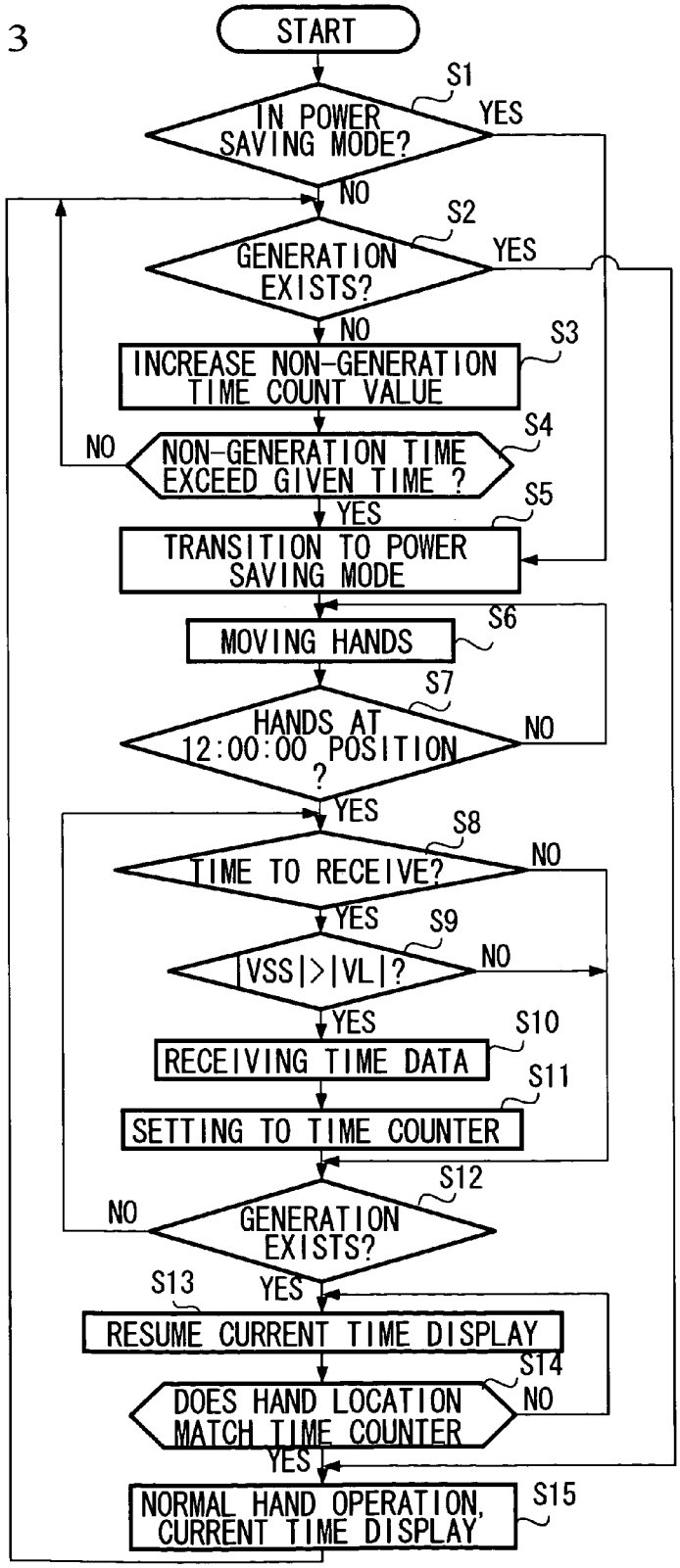
FIG. 3 is a flowchart showing an operation of the first embodiment of the present invention.

With reference to the flowchart in FIG. 3, the operation of the first embodiment of the present invention will be described by dividing to the following three stage;

- operation during the display mode
- operation during the power saving mode and during the transition from the display mode to the power saving mode
- operation during the transition from the power saving mode to the display mode

[1.2.1] Operation During the Display Mode

First in the flowchart, the drive controller circuit 24 judges if the current operation mode set by the mode controller circuit 96 is the power saving mode (step S1). In this explanation, the operation mode is the display mode (step S1; NO), so the generation detecting circuit 91 determines the amount of generation by the generating device 40 and judges whether or not the state of the generating device 40 is in the generating state (step S2). In the judgement at the step S2, when the generation detecting circuit 91 judges that the generating device 40 is in the generating state (step S2; YES), the process of the flowchart proceeds to the step S15. Then the normal hand movement is conducted, and the current time display is continued (step S15). Then again the process is returned to the step S2, and the process of the flowchart continues.

[1.2.2] Operation During the Power Saving Mode and During the Transition from the Display Mode to the Power Saving Mode In the display mode, the processes of the step S2 and S15 is repeatedly conducted. Only when the non-generation time exceeds a prescribed time, the operation mode is switched from the display mode to the power saving mode. Therefore, at the step S2, when the generation detecting circuit 91 judges that the generating device 40 is in the non-generation state (step S2; NO), the non-generation time measuring circuit 84 increases the counted value which is a value counted during the non-generation state (step S3). Next, the mode controller circuit 96 makes a judgement whether or not the counted value by the non-generation time measuring circuit 84 exceeds a prescribed value which corresponds to a prescribed non-generation time (step S4). When the answer is no, the process of the flowchart goes on to the step S2.

On the other hand, at the step S4, when the mode controller circuit 96 judges that the counted value by the non-generation time measuring circuit 84 exceeds a prescribed value which corresponds to a prescribed non-generation time (step S4; YES), the mode controller circuit 96 switches the operation mode from the display mode to the power saving mode, and sends to the drive controller circuit 24 a power saving mode signal which indicates that the operation mode is the power saving mode (step S5).

Then the drive controller circuit 24 continues driving the hands until the counted values of the hour-and-minute location counter 86 and second location counter 82 reach, for example, a counted values which correspond to hands locations of 12:00:00 (step S6). The time data controller circuit 93 makes a judgement if the counted values of the counters 82 and 86 are values corresponding to the hand locations of 12:00:00 (step S7).

At the step S7, when the time data controller circuit 93 judges that the counted values have values corresponding to other than 12:00:00 (step S7; NO), the process of the flowchart goes on to the step S6.

On the other hand, at the step S7, the time data controller circuit 93 makes a judgement that the counted values have values corresponding to the hand location of 12:00:00 (step S7; YES), the operation mode is switched to the power saving mode. Next, the circuit 93 makes a judgement if it is a time to start to receive the time data (step S8). At the step S8, when the circuit 93 makes a judgment that it is not a time to start to receive the time data (step S8; NO), the process of the flowchart goes on the step S12.

On the other hand, at the step S8, when the time data controller circuit 93 makes a judgment that it is a time to start to receive the time data (step S8; YES), the charge voltage detecting circuit 92 makes a judgement if the voltage Vss exceeds a lower limit voltage VL by which receiving the time data becomes possible (step S9). When the judgement of the step S9 is NO, process of the flowchart goes on to the step S12.

On the other hand, when the judgement of the step S9 is YES, the receiver circuit 25 receives the time data through the antenna 26 and sends the time data to the time data controller circuit 93 (step S10). The circuit 93 then adjusts the counted values of the counters 98 and 99 to the current time based on the time data (step S11).

Next, the generation detecting circuit 91 determines the amount of the generation of the generating device 40, and judges if the state of the device 40 is in the generating state (step S12). In the power saving mode, at the step S12, the circuit 91 judges that the state of the device 40 is in the non-generating state (step S12; NO), the process of the flowchart returns to the step S8. Then during the power saving mode, as shown in the flowchart, when the time comes to receive the time data, the voltage Vss is checked if it is high enough to receive the time data. Then when the voltage Vss is high enough, receiving the time data is conducted (step S10), and adjusting the time counter to the current time is conducted (step S1). These operations are carried out repeatedly until the transition to the display mode.

[1.2.3] Operation During Transition from the Power Saving Mode to the Display Mode Transition from the power saving mode to the display mode is carried out when a prescribed generation is occurring. Therefore, at the transition from the power saving mode to the display mode, the generation detecting circuit 91 judges that the state of the generating device 40 is in the generating state (step S12; YES). By this, the time data controller circuit 93 starts a transition operation from the power saving mode to the display mode (step S13).

In more concrete explanation of the transition to the display mode, the second counter circuit 94 counts the fast-forward pulses supplied from the drive controller circuit 24 to the second drive circuit 30S by using the second location counter 82. When the counted value of the second location counter 82 matches the counted values of the second time counter 98, the second matching detecting circuit 85 generates a control signal to stop sending fast-forward pulses. By supplying the control signal to the second drive circuit 30S, the second hand is adjusted to the current time (step S13 and S14).

On the other hand, the hour-and-minute counter circuit 95 counts the fast-forward pulses supplied from the drive controller circuit 24 to the hour-and-minute drive circuit 30HM by using the hour-and-minute location counter 86. When the counted value of the hour-and-minute location counter 86 matches the counted value of the hour-and-minute time counter 99, the hour-and-minute matching detecting circuit 87 generates a control signal to stop sending fast-forward pulses. By supplying the control signal to the hour-and-minute drive circuit 30HM, the hour hand and the minute hand is adjusted to the current time (step S13 and S14).

In this explanation, when switching to the display mode, the second hand is adjusted first, and then other hands are adjusted. However, this order is not limited to this. The hour hand and the minute hand can be adjusted first. Or the hour hand, the minute hand, and the second hand can be adjusted simultaneously. Then after the transition to the display mode which displays the current time, the normal hand movement is carried out and displaying the current time is continued (step S15).

[1.3] Modifications of the First Embodiment

[1.3.1] First Modification

In the first embodiment of the present invention, when switching to the power saving mode, the hands are let move to the positions corresponding to "12:00:00" and then the hands are stopped. However, there is no necessity to limit the positions of the hands to "12:00:00", other time is possible. In other word, if the current positions of the hands matches the counted values of the second location counter 82 and the hour-and-minute location counter 86, and if by changing the counted values of the second location counter 82 and the hour-and-minute location counter 86 the hands can be adjusted correctly, there is no necessity to limit the positions of the hands to "12:00:00".

[1.3.2] Second Modification

In the first embodiment of the present invention, when switching from the display mode to the power saving mode, the location of the hands are let move to the positions corresponding to "12:00:00" and then the transition is carried out. However, when switching from the display mode to the power saving mode, it is possible to use other configuration that the counted values of the second location counter 82 and the hour-and-minute location counter 86, both values being corresponding to the hands location at the time of transition, are stored in non-volatile memory or other storage means, and then transition to the power saving mode is carried out. In this case, when switching from the power saving mode to the display mode, the counted values stored in the non-volatile memory or other storage means are read out, then the values are set to the second location counter 82 and the hour-and-minute location counter 86, and by using the set values as a reference the transition to current time display is carried out. In this way, counted values of the second location counter 82 and the hour-and-minute location counter 86 are stored in non-volatile memory, so stopping the hands can be conducted immediately. So there is no need to continue to move the hands to the position of "12:00:00" as in the first embodiment of the invention. Hence the power consumption can be more reduced.

[1.4] Effect of the First Embodiment

As explained above, by the first embodiment of the present invention, even during the power saving mode, the time data is periodically received and is set to the counted values of the hour-and-minute time counter 99 and the second time counter 98. So when switching from the power saving mode to the display mode, it is possible to display correct time without receiving the time data over again.

[2] Second Embodiment

In contrast to the first embodiment of the present invention, in which actual location of the hands are not determined, a second embodiment of the present invention is with a mechanism by which actual location of the hand is determined in order to perform a current time display more correctly when switching from the power saving mode to the display mode.

[2.1] Configuration of the Second Embodiment

Figure 6:
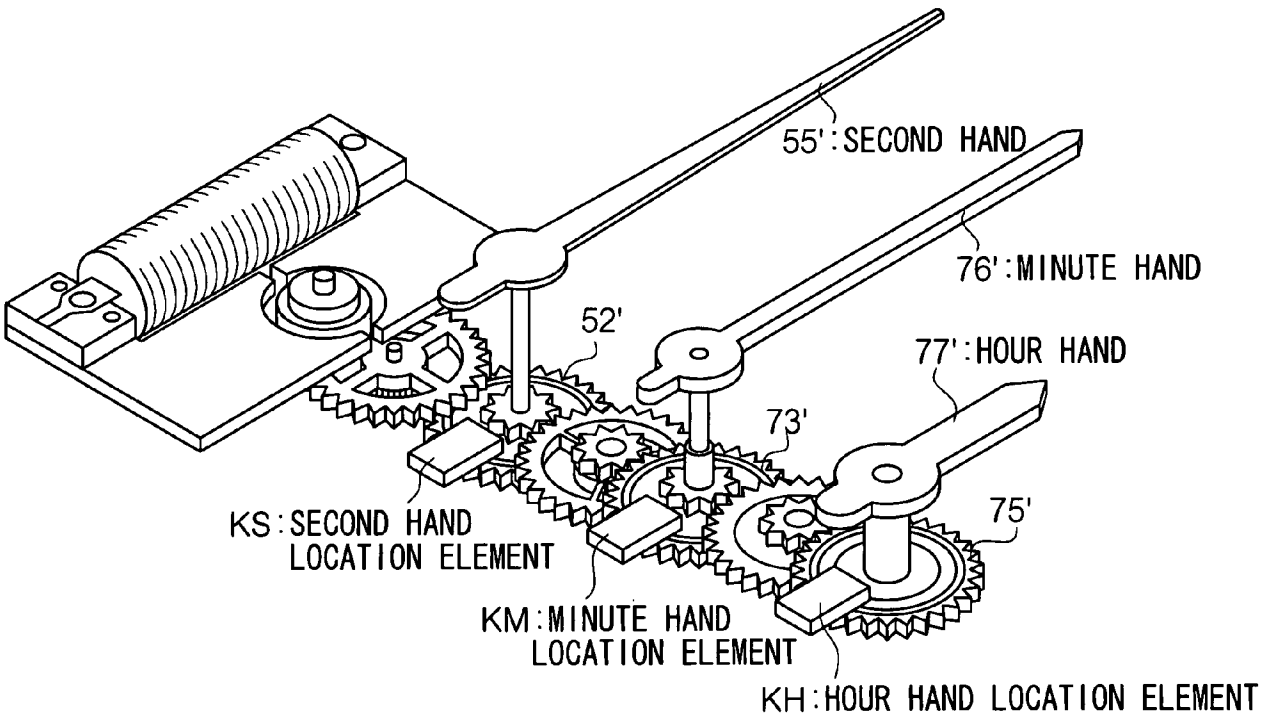
FIG. 6 shows a configuration of a hand location determining element of the second embodiment of the present invention.

FIG. 6 shows a configuration of a hand location determining element assembled in the hand movement mechanism of the time keeping apparatus of the second embodiment of the present invention. For the sake of easy understandings of the configuration of the hand location determining element, in FIG. 6, the hour hand, the minute hand, and the second hand are configured to be driven by one drives motor. The time keeping apparatus of the second embodiment of the present invention has the same configuration with the first embodiment shown in FIGS. 1 and 2 except that the second embodiment has a second hand location element KS, a minute hand location element KM, and an hour hand location element KH.

The second hand location element KS finds out the location of the second hand by checking magnetic substance put on the cogs of the second wheel 52' with a hall element or other means having similar function. In this configuration, the magnetic substance is magnetized in a prescribed magnetic information pattern. The minute hand location element KM, and the hour hand location element KH do the same operation. By these operation, when switching the operation mode from the display mode to the power saving mode, it is possible to stop the hand regardless of hands location at the moment of transition, hence power consumption can be more reduced.

[2.2] Operation of the Second Embodiment

In the first embodiment of the present invention, when switching from the display mode to the power saving mode, the transition is carried out after the hands reaches to the point of "12:00:00". Further, when switching from the power saving mode to the display mode, the transition to the current time display is carried out on a basis of the fact that the hands are on the point of "12:00:00". On the other hand, in the second embodiment of the present invention, when switching from the display mode to the power saving mode, transition is carried out regardless of the hands location at the moment of transition. After switching from the power saving mode to the display mode, at the transition to the current time display, based on the hands locations which the second hand location element KS, the minute hand location element KM, and the hour hand location element KH found out, the current time display is achieved.

Figure 7:
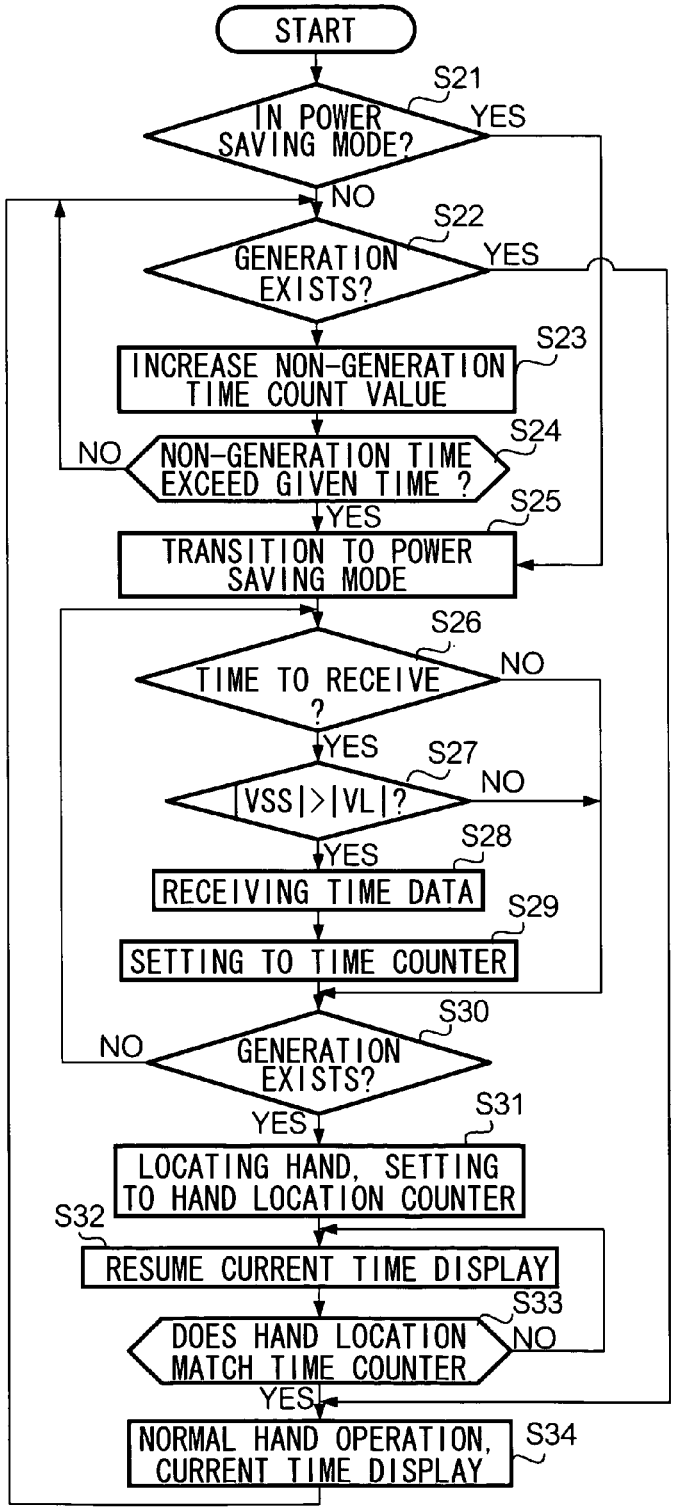
FIG. 7 is a flowchart showing an operation of the second embodiment of the present invention.

With reference to the flowchart shown in FIG. 7, the operation of the second embodiment of the present invention will be described by dividing to the following three stage;

operation during the display mode operation during the power saving mode and during the transition from the display mode to the power saving mode operation during the transition from the power saving mode to the display mode.

[2.2.1] Operation During the Display Mode

First in the flowchart, the time data controller circuit 93 makes a judgement if the current operation mode set by the mode controller circuit 96 is the power saving mode (step S21). In this explanation, the operation mode is the display mode (step S21; NO), so the generation detecting circuit 91 measures the amount of generation by the generating device 40 and judges whether or not the state of the generating device 40 is in the generating state (step S22). In the judgement at the step S22, when the generation detecting circuit 91 judges that the generating device 40 is in the generating state (step S22; YES), the process of the flowchart proceeds to the step S34. Then the normal hand movement is conducted, and the current time display is continued (step S34). Then again the process is returned to the step S22, and the process of the flowchart continues.

[2.2.2] Operation During the Power Saving Mode and During the Transition from the Display Mode to the Power Saving Mode In the display mode, operations of step S22 and S34 is repeatedly carried out, and when non-generation time period lasts more than a prescribed time period, the operation mode is switched from the display mode to the power saving mode. Therefore, at the step S22, when the generation detecting circuit 91 judges that the state of the generating device 40 is in non-generating state (step S22; NO), the non-generation time measuring circuit 84 increases the counted value which is a value counted during the non-generation state (step S23). Next, the mode controller circuit 96 makes a judgement whether or not the counted value by the non-generation time measuring circuit 84 exceeds a prescribed value which is corresponding to a prescribed non-generation time (step S24).

When the answer is no at the step S24, the process of the flowchart goes on to the step S22.

When the answer is yes at the step S24, the non-generation time measuring circuit 84 switches the operation mode from the display mode to the power saving mode, and sends to the time data controller circuit 93 a power saving mode signal which indicates that the operation mode is in the power saving mode (step S25).

In this way, by the second embodiment, it is possible to immediately stop the hand regardless of its location. Therefore, it is possible to reduce the power consumption, because it is not necessary to continue to carry out the operation of the apparatus until the hand reaches to the position of "12:00:00" when switching to the power saving mode.

Next, the circuit 93 makes a judgement if it is a time to start to receive the time data (step S26). At the step S26, when the circuit 93 makes a judgment that it is not a time to start to receive the time data (step S26; NO), the process of the flowchart goes on the step S30.

On the other hand, at the step S26, when the time data controller circuit 93 makes a judgment that it is a time to start to receive the time data (step S26; YES), the charge voltage detecting circuit 92 makes a judgement if the voltage Vss exceeds a lower limit voltage VL by which receiving the time data becomes possible (step S27).

When the judgement of the step S27 is NO, process of the flowchart goes on to the step S30. When the judgement of the step S27 is YES, the receiver circuit 25 receives the time data through the antenna 26 and sends the time data to the time data controller circuit 93 (step S28). The circuit 93 then adjusts the counted values of the counters 98 and 99 to the current time based on the time data (step S29).

Next, the generation detecting circuit 91 measures the amount of the generation of the generating device 40, and judges if the state of the device 40 is in the generating state (step S30). In the power saving mode, at the step S30, the circuit 91 judges that the state of the device 40 is in the non-generating state (step S30; NO), the process of the flowchart returns to the step S26. Then during the power saving mode, as shown in the flowchart, when the time comes to receive the time data, the voltage Vss is checked if it is high enough to receive the time data. Then when the voltage Vss is high enough, receiving the time data is conducted (step S28), and adjusting the time counter to the current time is conducted (step S29). These operations are carried out repeatedly until the transition to the display mode.

[2.2.3] Operation During the Transition from the Power Saving Mode to the Display Mode The transition from the power saving mode to the display mode is carried out when a prescribed generation is occurring. Therefore, when the transition from the power saving mode to the display mode is carried out, the generation detecting circuit 91 makes a judgement that the generating device 40 is in the generating state (step S30; YES). By this, the time data controller circuit 93 starts an operation of switching the operation mode from the power saving mode to the display mode.

In more concrete explanation of the transition to the display mode, first, the second hand location element KS, the minute hand location element KM, and the hour hand location element KH checks the magnetic substance put on the cogs of the second wheel 52', the center wheel 73', and the hour wheel, and locates the second hand, minute hand, and hour hand. Then the counter values that correspond to the locations of the hands are set to the second location counter 82 and the hour-and-minute counter 86 (step S31).

By this, the locations of the hands before performing a current time display are related to the counter values of the hour-and-minute location counter 86 and second hand location counter 82. Then the counter values of the location counters 86 and 82 will be matched to the counted values of the second time counter 98 and the hour-and-minute time counter 99. By this, the hands can display the current time.

Next, the second hand, the minute hand, and the hour hand will be moved to display the current time (step S32).

In more concrete explanation of the operation of the current time display, the second counter circuit 94 counts the number of fast-forward pulses supplied from the drive controller circuit 24 to the second drive circuit 30S with the second location counter 82. When the counter value of the second location counter 82 matches the counted value of the second time counter 98, the second matching detecting circuit 85 generates a control signal to stop sending fast-forward pulses. By supplying the control signal to the second drive circuit 30S, the second hand is adjusted to the current time (step S32 and S33).

On the other hand, the hour-and-minute counter circuit 95 counts the fast-forward pulses supplied from the drive controller circuit 24 to the hour-and-minute drive circuit 30HM by using the hour-and-minute location counter 86. When the counted value of the hour-and-minute location counter 86 matches the counted values of the hour-and-minute time counter 99, the hour-and-minute matching detecting circuit 87 generates a control signal to stop sending fast-forward pulses. By supplying the control signal to the hour-and-minute drive circuit 30HM, the hour hand and the minute hand is adjusted to the current time (step S32 and S33).

In this explanation, when switching to the display mode, the second hand is adjusted first, and then other hands are adjusted. However, this order is not limited to this. The hour hand and the minute hand can be adjusted first. Or the hour hand, the minute hand, and the second hand can be adjusted simultaneously. After the transition to the display mode which displays the current time, the normal hand movement is carried out and displaying the current time is continued (step S34).

[2.3] Modifications of the Second Embodiment

In the second embodiment, in order to locate the hand locations, the second hand location element KS, the minute hand location element KM, and the hour hand location element KH are used for magnetic sensors. However, in addition, it is possible to use optical sensor assembled near the gear trains for hand drive. Or it is also possible to locate the hand location by using electric contact or other similar mechanism.

To be more specific, putting a prescribed black and white pattern on the gear wheel, and reading the pattern by a photo acceptance unit make it possible too. Also putting a prescribed conductive and unconductive pattern on the gear wheel, and reading the pattern by continuity check make it possible too.

[2.4] Effect of the Second Embodiment

As explained above, in the second embodiment of the present invention, even in the power saving mode, time data is periodically received and set to the counted values of the hour-and-minute location counter 86 and the second location counter 82. So without receiving the time data again when switching from the power saving mode to the display mode, correct current time can be obtained.

When switching from the power saving mode to the display mode, the second hand location element KS, the minute hand location element KM, and the hour hand location element KH locate the locations of the hands and the counter values corresponding to them are set to the second location counter 82 and the hour-and-minute location counter 86. Then the current time display is performed based on the set values. Therefore, it is possible to obtain correct time display. Also when switching to the power saving mode, the hands are immediately stopped, so the power consumption is reduced more.

[3] Third Embodiment

Figure 11:
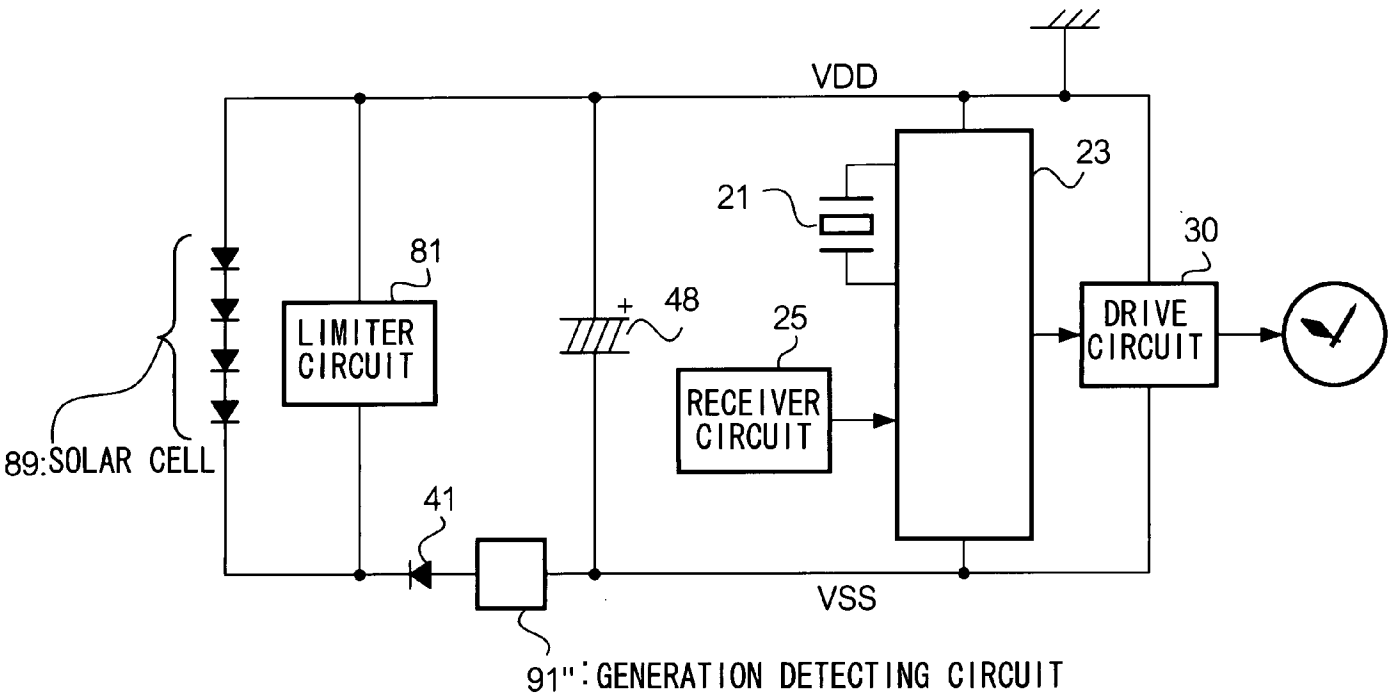
FIG. 11 shows a schematic configuration of a time keeping apparatus of the third embodiment of the present invention.

In the third embodiment of the present invention, a solar cell is used for the power generation unit A. In FIG. 11, a schematic configuration of a time keeping apparatus of the third embodiment of the present invention is shown. In FIG. 11, each part identical to that in FIG. 1 has the same symbol as in FIG. 1, so its detailed explanation is omitted. The time keeping apparatus of the third embodiment of the present invention comprises a standard oscillation source 21, a controller circuit 23, a receiver circuit 25, a drive circuit 30, a countercurrent prevention diode 41, a large capacitance battery 48, a limiter circuit 81, a solar cell 89, and a generation detecting circuit 91". The solar cell 89 converts light energy into electric energy. The countercurrent prevention diode 41 is used to prevent the stored charge in the battery 48 from flowing back.

Figure 12:
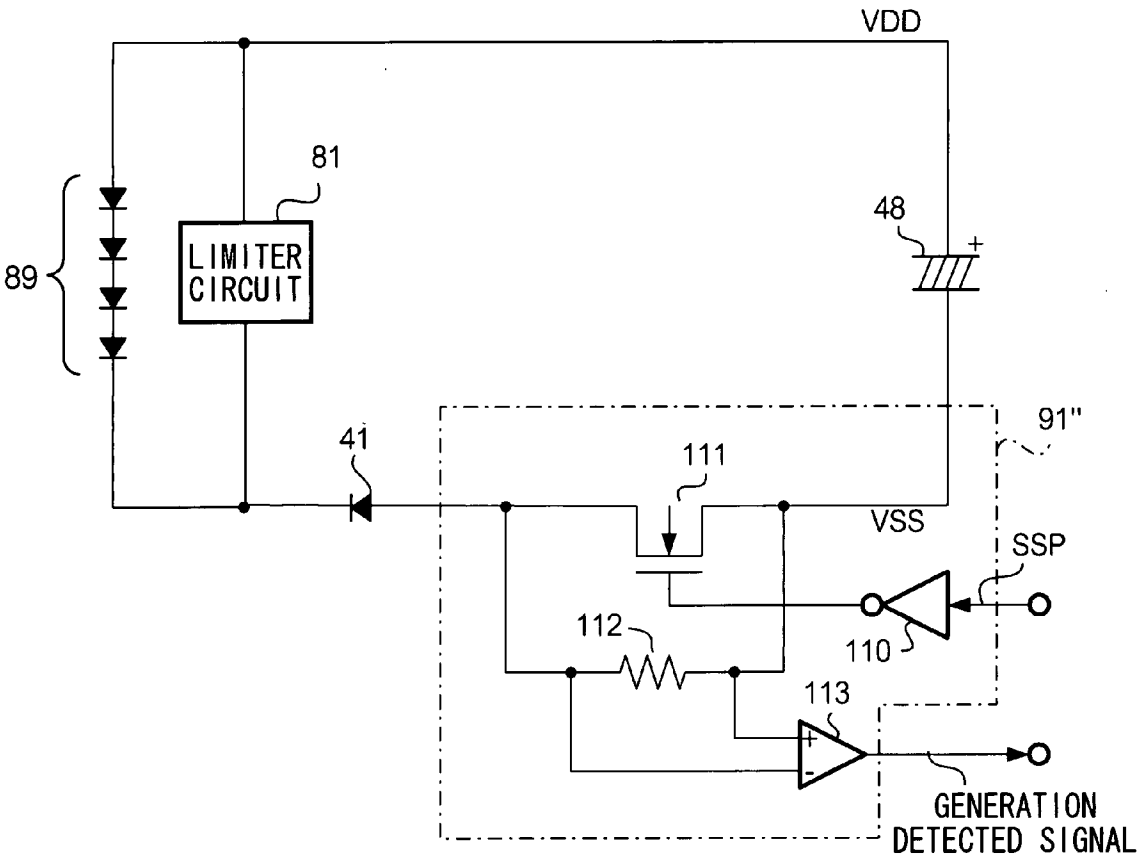
FIG. 12 shows a schematic configuration of a generation detecting circuit of the third embodiment of the present invention.

With reference to FIG. 12, operation of the generation detecting circuit 91" will be described. A sampling signal SSP supplied from the controller unit C intermittently becomes the high level. By this, an output signal of a inverter 110 intermittently becomes the low level, an n-channel transistor 111 intermittently becomes the OFF state and the generation detecting circuit 91" intermittently becomes a generation detected state. The reason that the generation detecting circuit 91" intermittently becomes a generation detected state is that in the third embodiment, generation is continuously occurring. Therefore, in the non-generation detected state where the n-channel transistor 111 is the ON state, when the solar cell 89 converts light energy to electrical energy, the battery 48 is charged via the n-channel transistor 111.

Also in the generation detected state where the n-channel transistor 111 is the OFF state, when a voltage drop between the terminals of the resistor 112 is determined to be more than a prescribed value by a detecting comparator 113, the generation detected signal becomes the generation detected state that means the solar cell are converting light energy to electrical energy. In this case, it is possible to apply voltage between the non-inverting terminal and the inverting terminal of the comparator 113, by this, detection sensitivity can be adjustable.

By this configuration, in a case when the generator can continuously generates electricity as by solar cell 89, it is possible to detect generation more securely, and to enable more natural mode transition to the user.

Also, a user may switch from the power saving mode to the display mode by operating an external input device. By operating the external input device manually, a user can switch from the power saving mode to the normal operation mode in order to display a current time quickly in a case where it takes too much time to switch from the power saving mode to the display mode because the solar cell 89 generates less electricity in dim environments.

[4] Fourth Embodiment

In the first and the second embodiments, the generator is an electromagnetic induction type generator and can produce a relatively large electromotive force. In the third embodiment, the generator is a solar cell. However, in the forth embodiment of the present invention, generator unit comprises a generator such as thermoelectric generator which produce a relatively small electromotive force. In the fourth embodiment, charging the battery is conducted after boosting voltage at a booster circuit in subsequent stage. The booster circuit is also used to make voltage for writing to non-volatile memory. This non-volatile memory stores information necessary to resume to perform a time display. For example, the second modification of the first embodiment uses the non-volatile memory in this way.

Figure 13:
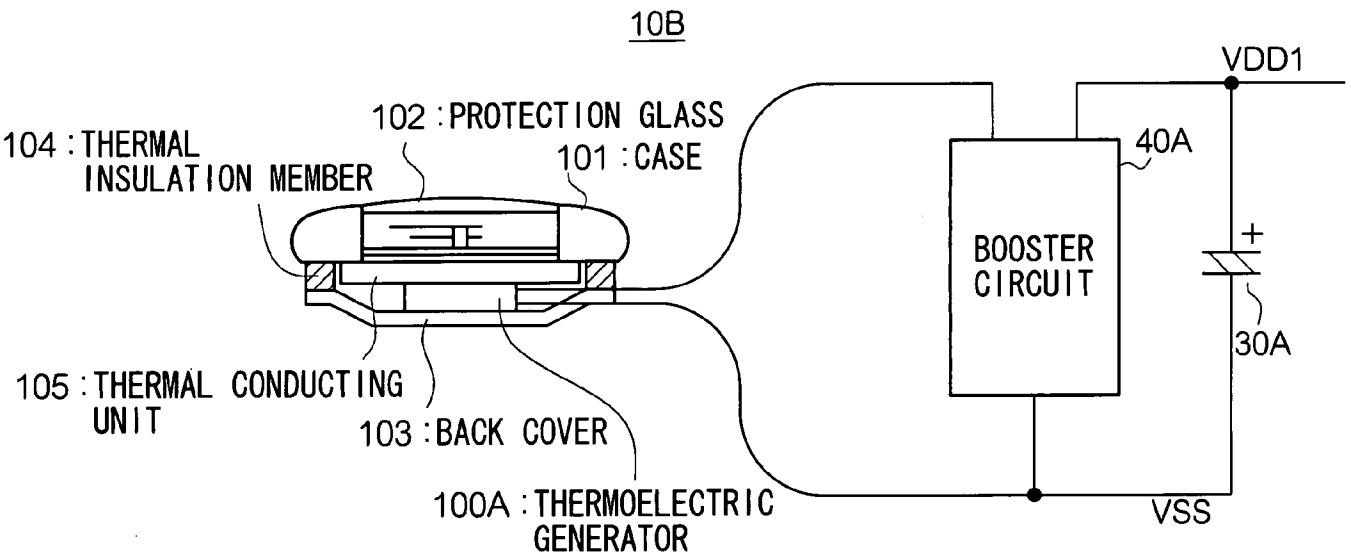
FIG. 13 shows a schematic configuration of a time keeping apparatus of the fourth embodiment of the present invention.

[4.1] Schematic Configuration of an Electric Analog Watch of the Fourth Embodiment FIG. 13 is a schematic configuration of an analog electrical timepiece using a thermoelectric device. An analog electrical timepiece 10B comprises a thermoelectric generator 100A, a case 101, a protection glass 102, a back cover 103, a thermal insulation member 104, and a thermal conducting unit 105. The thermoelectric generator 100A generates electricity by using temperature difference. The case 101 contains mechanical units. The protection glass 102 protects hands. The back cover 103 cooperates with the case 101 to contain mechanical units. The thermal insulation member 104 prevents heat from conducting between the case 101 and the back cover 103. The thermal conducting unit 105 conducts heat fast from back cover 103 to the case 101, and produces thermal gradient between back cover 103 side of the thermoelectric generator 100A and case 101 side of the thermoelectric generator 100A. The thermoelectric generator 100A is connected to a high capacitance capacitor 30A via a booster circuit 40A which is placed at subsequent stage.

Next, an outlined operation of the analog electrical timepiece with thermal generating device will be described. When the user wears the analog electrical timepiece 10B, heat of the user moves to the back cover 103, and temperature at the back cover side of the thermoelectric generator 100A goes up.

On the other hand, heat at the case side of the thermoelectric generator 100A is released to the atmosphere via the thermal conducting unit 105 and the case 101. So, thermal gradient is produced between the back cover 103 side of the thermoelectric generator 100A and the case 101 side of the thermoelectric generator 100A. Then the thermoelectric generator 100A generates electricity. The voltage at the generator 100A is usually from 0.4 to 0.5 volts when the apparatus is carried by the user.

Then the voltage at the thermoelectric generator 100A is boosted from three to eight times, since the operating voltage of the apparatus is around from 1.4 to 3 volts. Then the boosted voltage becomes a battery voltage VDD1, and is stored in the high capacitance capacitor 30A.

[4.2] Effect of the Fourth Embodiment

As explained above, according to the fourth embodiment of the present invention, it is possible to use the booster circuit 40A for power source to other circuit. In this case, the booster circuit 40A is also used for making voltage for writing to non-volatile memory. In the fourth embodiment, the booster circuit 40A boosts the voltage generated by the thermoelectric generator and generates a power supply voltage for the analog electrical timepiece.

Therefore, if there is a circuit which requires high voltage, it is possible to make circuit size smaller by reducing a number of boosting stage. Hence it is possible to make the size of IC chip smaller and to reduce the cost of the apparatus.

[5] Fifth Embodiment

[5.1] Configuration of the Fifth Embodiment

Figure 14:
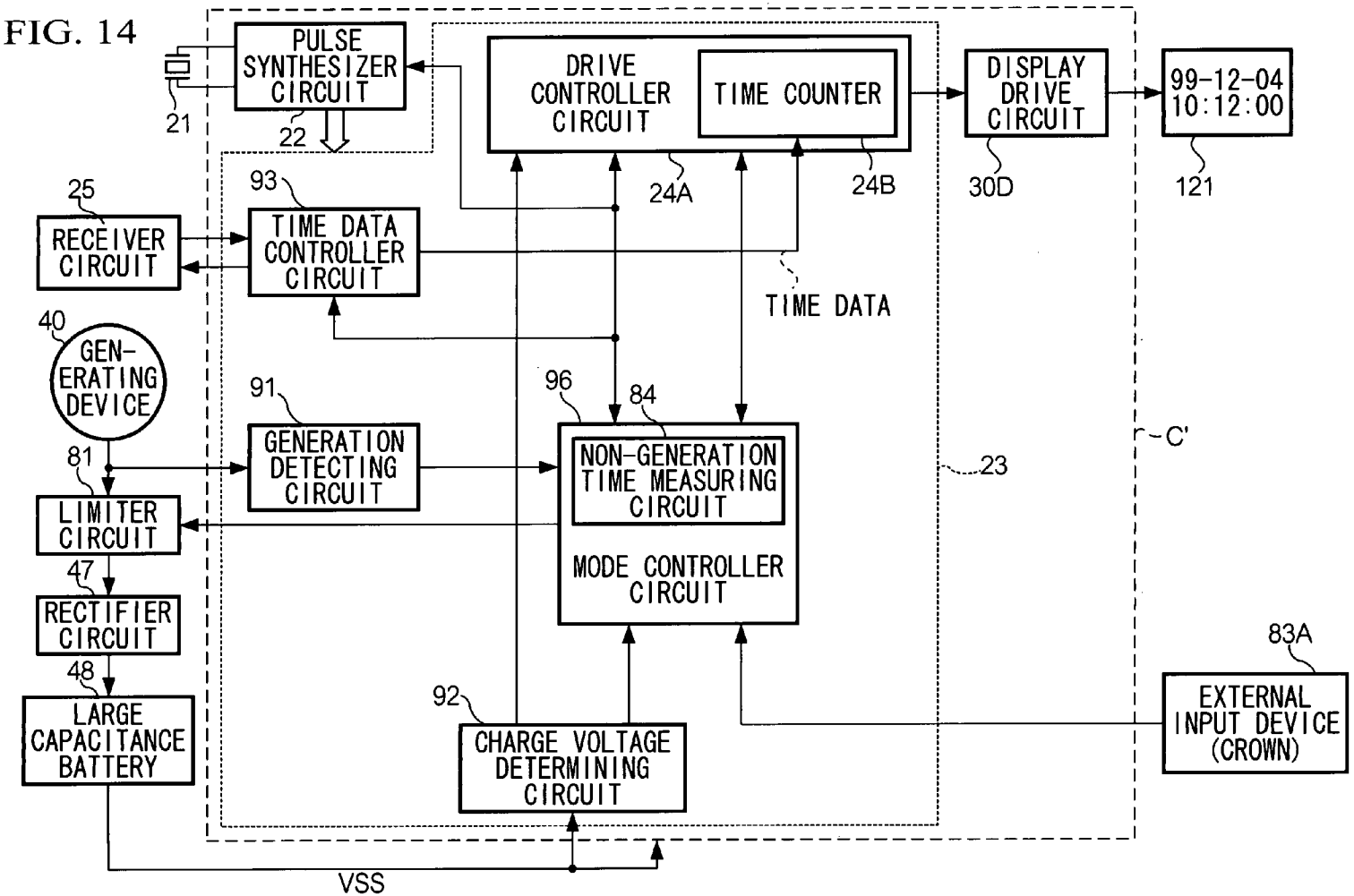
FIG. 14 is a block diagram showing an outlined configuration of a controller unit of the fifth embodiment of the present invention.

With reference to the drawings, the fifth embodiment of the present embodiment will be described. FIG. 14 is a functional block diagram showing a configuration of a controller unit C' and its peripheral structure of the fifth embodiment of the present invention. In FIG. 14, each part identical to that in FIG. 2 has the same symbol as in FIG. 2, so its detailed explanation is omitted.

In the above embodiments, explanation is given for analog timepiece. However, in the fifth embodiment, the present invention is applied to a digital timepiece.

The controller unit C' comprises a pulse synthesizer circuit 22, a drive controller circuit 24A, a generation detecting circuit 91, a charge voltage determining circuit 92, a mode controller circuit 96, and a time data controller circuit 93.

The drive controller circuit 24A comprises a time counter 24B. The time counter 24B counts time that is to be displayed on a display 121. The display 121 is connected to the time counter 24B via a display drive circuit 30D. For display 121, a liquid crystal display (LCD), an organic electroluminescence (EL) display, or a light emitting diode (LED) display will be used. The mode controller circuit 96 is connected to a switch 83A that functions as an external input device.

[5.2] Operation of the Fifth Embodiment

Next, operations of substantial parts of the fifth embodiment will be described. In the display mode, the mode controller circuit 96 brings the display drive circuit 30D to an operation state. The drive controller circuit 24A receives an output of the pulse synthesizer circuit 22, by this the time counter 24B counts current time.

Then the display drive circuit 30D performs a time display on the display 121 based on the counted value of the time counter 24B.

When switching from the display mode to the power saving mode, the mode controller circuit 96 brings the display drive circuit 30D to a non-operation state. By this, the display 121 stops time display. During the power saving mode, when a time comes to receive time data, the time data controller circuit 93 receives the time data via the receiver circuit 25 and sets the received time data to the timer counter 24B. These operations are carried out repeatedly until the transition to the display mode.

Figure 17:
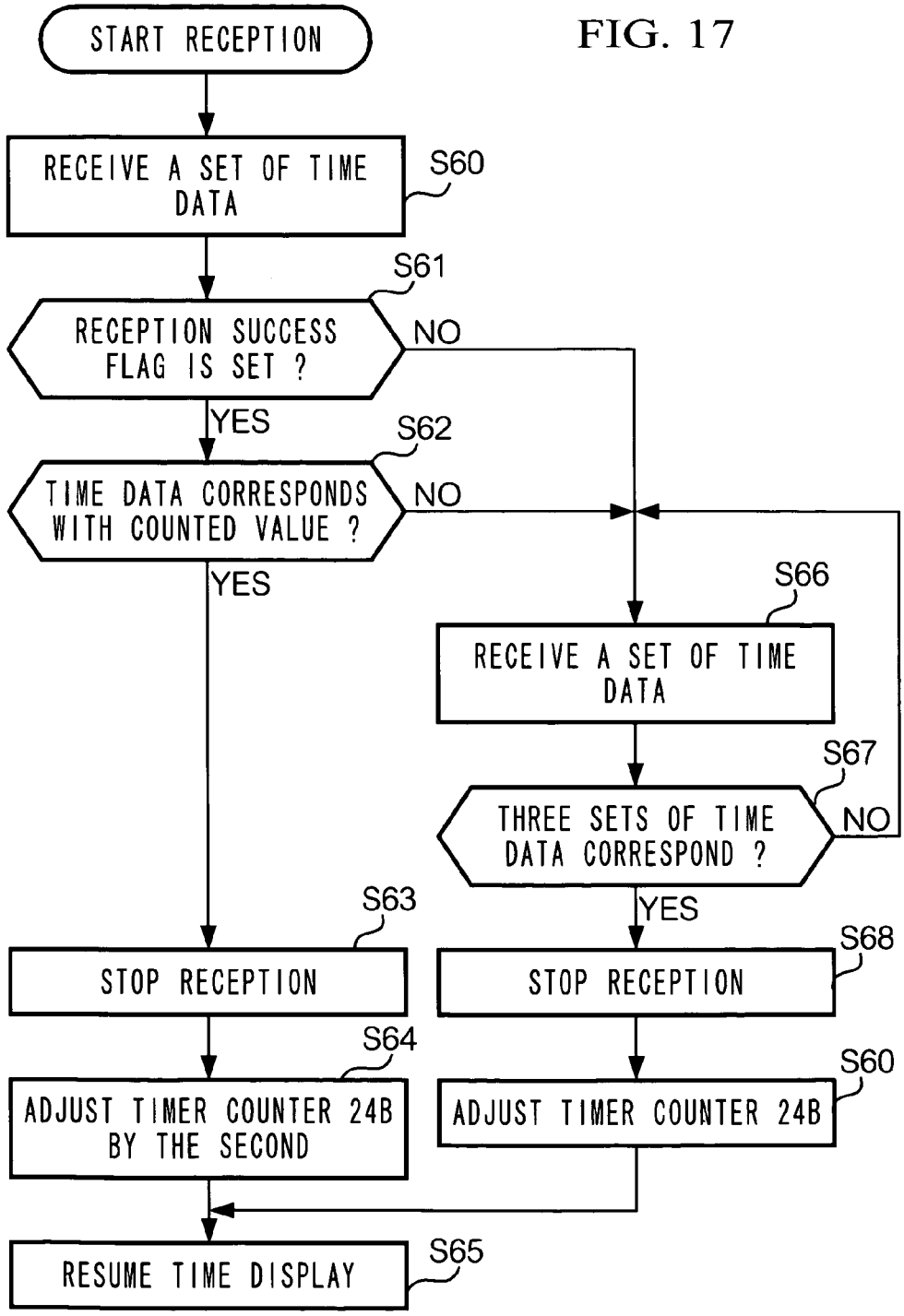
FIG. 17 is a flowchart showing an operation during transition from the power saving mode to the display mode of the fifth embodiment of the present invention.

Next, the operation during transition from the power saving mode to the display mode will be described with reference to FIG. 17.

The time data controller circuit 93, immediately after switching from the power saving mode to the display mode, receives a set of time data (step S60). The time data controller circuit 93, upon receiving the set of time data, determines whether a reception success flag is set (step 61). This flag is set when time data has been received successfully, and reset after a predetermined time period such as 24 hours. When the flag is set within a past predetermined time period (step 61; YES), the time data controller circuit 93 determines whether the received time data corresponds with the counted value of the time counter 24B (step 62). The time data controller circuit 93, when the time data corresponds with the counted value (step 62; YES), stops receiving time data (step 63), and adjusts the value data of the timer counter 24B by the second (step 64). When the mode controller circuit 96 brings the display drive circuit 30D to an operation state, the display drive circuit 30D resumes performing time display on the display 121 based on the counted value of the time counter 24B (step 65).

On the other hand, when the flag is not set (step 61; NO) or when the time data does not correspond with the counted value (step 62; NO), the time data controller circuit 93 repeats the operation of receiving a set of time data until three sets of time data correspond (step 66). The correspondence of time data means that a rate of changes among each sets of time indicated by each time data is constant. For example, when firstly received time data of three sets of time data which are received in succession at one minute intervals indicates "12:00", secondly and thirdly received time data indicate "12:01" and "12:02" respectively, which means that the three sets of time data correspond. The time data controller circuit 93, when the three sets of time data correspond (step 67; YES), stops receiving time data (step 68), and adjusts the value data of the timer counter 24B on the basis of the time data (step 69). The mode controller circuit 96 brings the display drive circuit 30D to an operation state, and the display drive circuit 30D resumes performing time display on the display 121 based on the counted value of the time counter 24B (step 65).

On the other hand, when the three sets of time data do not correspond (step 67; NO), the process of the flowchart goes to the step 66.

In a case of the time keeping apparatus according to the fifth embodiment which receives time data even during the power saving mode, it is possible that a reception success flag is set. In this case, it is possible to adjust time quickly because it is unnecessary to receive three sets of time data.

[5.3] Modifications of the Fifth Embodiment

[5.3.1] First Modification

In the fifth embodiment, when switching from the display mode to the power saving mode, a time display on the display 121 is stopped completely. However, a part of the time display on the display 121 may be stopped. For example, when switching from the display mode to the power saving mode, it is possible to stop only displaying seconds, which consumes electricity most because it is updated each second, and to continue displaying hours, minutes, and a calendar.

[5.3.2] Second Modification

In the fifth embodiment, when switching from the display mode to the power saving mode, a time display on the display 121 is stopped completely. However, the display may continue to display an indication such as "SLEEP" instead of the time. In this case, a user can distinguish a suspension of displaying the time during the power saving mode from that due to electricity shortage of a secondary battery or a failure of a time keeping apparatus.

[5.4] Effect of the Fifth Embodiment

As explained above, according to the fifth embodiment of the present invention, even during the power saving mode, time data is periodically received and is set to the time counter 24B. Thus, when switching from the power saving mode to the display mode, current time display is correctly performed immediately after time data is received.

[6] Variations

[6.1] First Variation

In the above embodiments, the generation detecting circuit 91 is used. However a generation detecting circuit 91' shown in FIG. 8 can be used instead.

Figure 8:
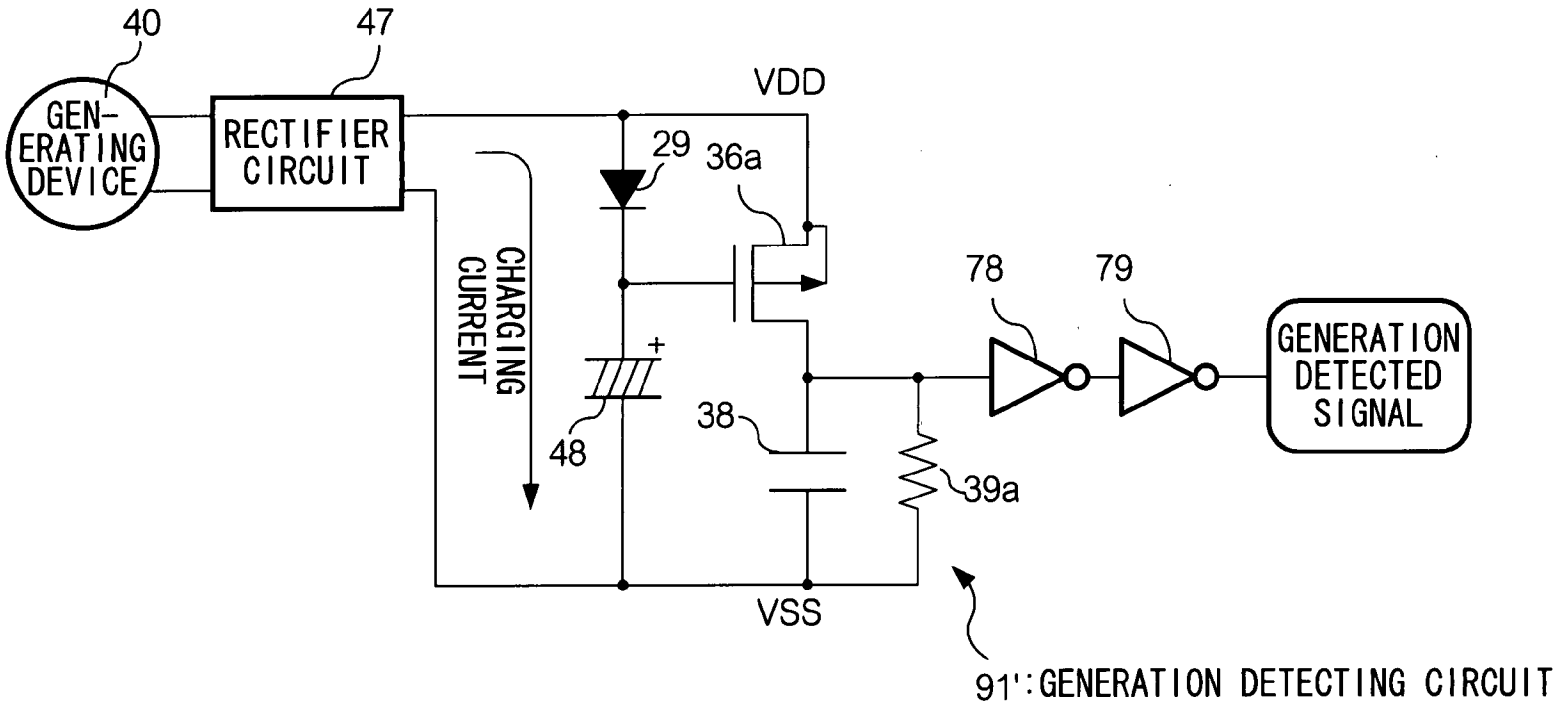
FIG. 8 is a block diagram showing a modification of the generation detecting circuit.

A detailed configuration of the generation detecting circuit 91' will be described by referring to FIG. 8. The generation detecting circuit 91' comprises a diode 29, a transistor 36*a*, a capacitor 38, a pull-down resistor 39*a*, an inverter 78, and an inverter 79. The diode 29 is placed between the positive terminal of the battery 48 and the higher electric potential side voltage Vdd. One terminal of the capacitor 38 is connected to the drain terminal of the transistors 36*a*. The other terminal of the capacitor 38 is connected to the lower electric potential side voltage Vss. The resistor 39*a* is connected in parallel with the capacitor 38 and is used for discharging the charge in the capacitor 38. One terminal of the resistor 39*a* is connected to the lower electric potential side voltage Vss. The inverter 78 is connected to the drain terminal of the transistor 36*a*. The inverter 79 is connected in series to the inverter 78, and the output signal of the inverter 79 is a detected generation signal.

Also it is possible to use a resistor instead of the diode 29. In this case, it is preferable to use a resistor which has a resistance of several hundred ohms.

In the above configuration, when voltage is induced in the generating device 40, charging current flows from the rectifier circuit 47 to the battery 48 via the diode 29. So between the cathode and the anode of the diode 29, a forward voltage Vf appears. When the forward voltage exceeds a threshold voltage Vth of the transistor 36*a*, the transistor 36*a* becomes the on. Then potential difference appears between the terminals of the capacitor 38. Since the input to the inverter 78 becomes the high level, the detected generation signal output from the inverter 79 becomes the high level. On the other hand, when no voltage is induced in the generating device 40, the transistor 36*a* remains the OFF. So the charge in the capacitor 38 is discharged by the pull-down resistor 39*a*. Then the voltage between the terminals of the capacitor 38 declines. Therefore, the input to the inverter 78 becomes the low level, and the detected generation signal output from the inverter 79 becomes the low level.

Hence, when no voltage is induced in the generating device 40, it is possible to reduce the power consumption to the zero in the generation detecting circuit 91'.

[6.2] Second Variation

Figure 15:
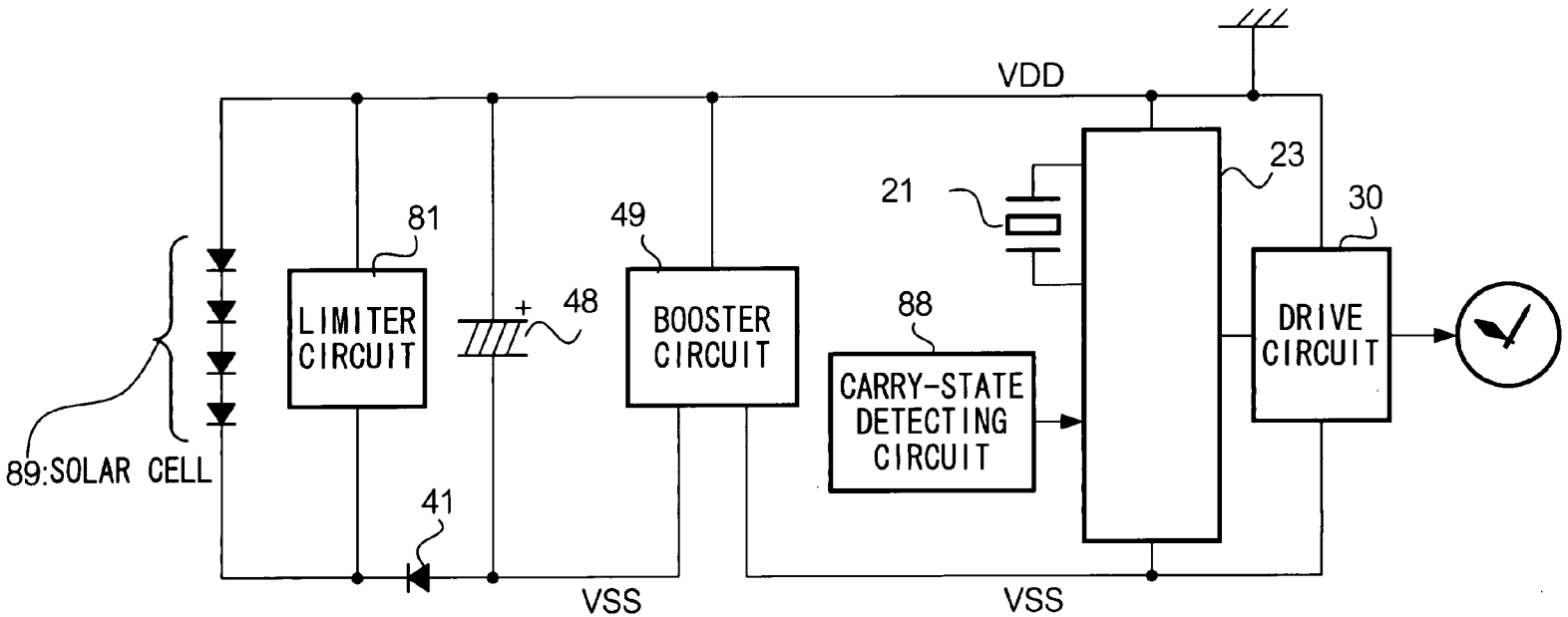
FIG. 15 is a block diagram showing a modification of the time keeping apparatus with a carry-state detecting circuit.

The above embodiments have the generation detecting circuit 91 in it. However instead of the circuit 91, a carry-state detecting circuit 88 shown in FIG. 15 can be used. The carry-state detecting circuit 88 detects a state of carrying of the time keeping apparatus and by this conducts mode transition between the power saving mode and the display mode.

[6.2.1] Operation Example of the Second Variation

Figure 16:
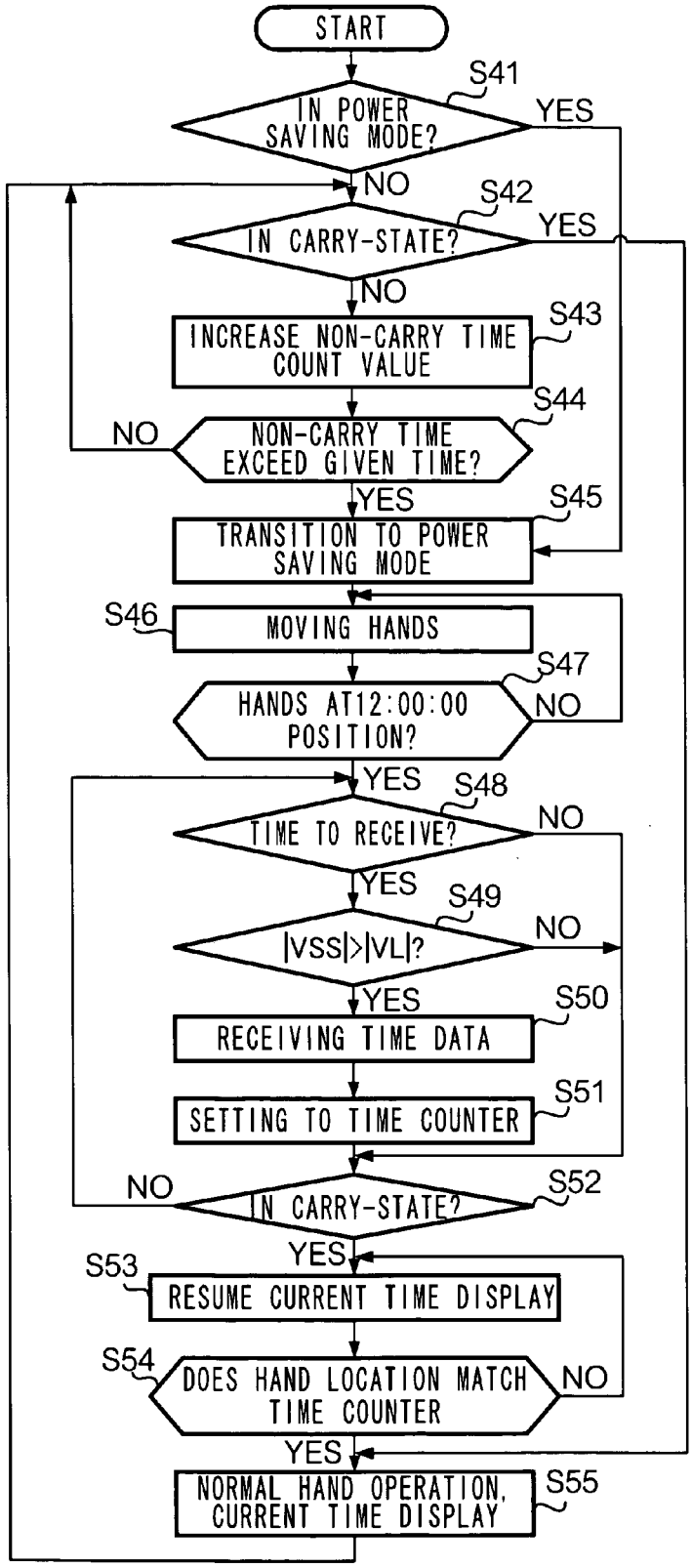
FIG. 16 is a flowchart showing an operation of the second variation of the first embodiment of the present invention.

By way of example, the operation of the time keeping apparatus according to the first embodiment, which comprises the carry-state detecting circuit 88 and the non-carry time measuring circuit 97 instead of the generation detecting circuit 91 and the non-generation time measuring circuit 84, will be described with reference to the flowchart in FIG. 16 as dividing in the following three stage:

operation during the display mode;

operation during the power saving mode and during the transition from the display mode to the power saving mode;

operation during the transition from the power saving mode to the display mode.

[6.2.1.1] Operation During the Display Mode

First in the flowchart, the drive controller circuit 24 judges if the current operation mode set by the mode controller circuit 96 is the power saving mode (step S41). In this explanation, the operation mode is the display mode (step S41; NO), so the carry-state detecting circuit 88 judges whether the time keeping apparatus 1 is in a carry-state (step S42). In the judgement at the step S42, when the carry-state detecting circuit 88 judges that the time keeping apparatus 1 is in the carry-state (step S42; YES), the process of the flowchart proceeds to the step S55. Then the normal hand movement is conducted, and the current time display is continued (step S55). Then, the process is returned to the step S42, and the process of the flowchart continues.

[6.2.1.2] Operation During the Power Saving Mode and During the Transition from the Display Mode to the Power Saving Mode In the display mode, the processes of the step S42 and S55 is repeatedly conducted. Only when the non-carry time exceeds a prescribed time is the operation mode switched from the display mode to the power saving mode. Therefore, at the step S42, when the carry-state detecting circuit 88 judges that the time keeping apparatus 1 is in the non-carry-state (step S42; NO), the non-carry time measuring circuit 97 increases the counted value which is a value counted during the non-carry state (step S43). Next, the mode controller circuit 96 makes a judgement whether or not the counted value by the non-carry time measuring circuit 97 exceeds a prescribed value which corresponds to a prescribed non-carry time (step S44). When the answer is no, the process of the flowchart goes on to the step S42.

On the other hand, at the step S44, when the mode controller circuit 96 judges that the counted value by the non-carry time measuring circuit 97 exceeds a prescribed value which corresponds to a prescribed non-carry time (step S44; YES), the mode controller circuit 96 switches the operation mode from the display mode to the power saving mode, and sends to the drive controller circuit 24 a power saving mode signal which indicates that the operation mode is the power saving mode (step S45).

Then the drive controller circuit 24 continues driving the hands until the counted values of the hour-and-minute location counter 86 and second location counter 82 reach, for example, a counted values which correspond to hands locations of 12:00:00 (step S46). The time data controller circuit 93 makes a judgement if the counted values of the counters 82 and 86 are values corresponding to the hand locations of 12:00:00 (step S47).

At the step S47, when the time data controller circuit 93 judges that the counted values have values corresponding to other than 12:00:00 (step S47; NO), the process of the flowchart goes on to the step S46.

On the other hand, at the step S47, the time data controller circuit 93 makes a judgement that the counted values have values corresponding to the hand location of 12:00:00 (step S47; YES), the operation mode is switched to the power saving mode. Next, the circuit 93 makes a judgement if it is time to start to receive the time data (step S48). At the step S48, when the circuit 93 makes a judgment that it is not time to start to receive the time data (step S48; NO), the process of the flowchart goes on the step S52.

On the other hand, at the step S48, when the time data controller circuit 93 makes a judgment that it is time to start to receive the time data (step S48; YES), the charge voltage detecting circuit 92 makes a judgement if the voltage Vss exceeds a lower limit voltage VL by which receiving the time data becomes possible (step S49). When the judgement of the step S49 is NO, process of the flowchart goes on to the step S52.

On the other hand, when the judgement of the step S49 is YES, the receiver circuit 25 receives the time data through the antenna 26 and sends the time data to the time data controller circuit 93 (step S50). The circuit 93 then adjusts the counted values of the counters 98 and 99 to the current time based on the time data (step S51).

Next, the carry-state detecting circuit 88 judges whether the time keeping apparatus 1 is in the carry-state (step S52). In the power saving mode, at the step S52, the circuit 88 judges that the time keeping apparatus 1 is in the non-carry-state (step S52; NO), the process of the flowchart returns to the step S48. Then during the power saving mode, as shown in the flowchart, when the time comes to receive the time data, the voltage Vss is checked if it is high enough to receive the time data. Then when the voltage Vss is high enough, receiving the time data is conducted (step S50), and adjusting the time counter to the current time is conducted (step S51). These operations are carried out repeatedly until the transition to the display mode.

[6.2.1.3] Operation During Transition from the Power Saving Mode to the Display Mode Transition from the power saving mode to the display mode is carried out when a prescribed carry-state is detected. Therefore, at the transition from the power saving mode to the display mode, the carry-state detecting circuit 88 judges that the time keeping apparatus is in the carry-state (step S52; YES). By this, the time data controller circuit 93 starts a transition operation from the power saving mode to the display mode (step S53).

In a more concrete explanation of the transition to the display mode, the second counter circuit 94 counts the fast-forward pulses supplied from the drive controller circuit 24 to the second drive circuit 30S by using the second location counter 82. When the counted value of the second location counter 82 matches the counted values of the second time counter 98, the second matching detecting circuit 85 generates a control signal to stop sending fast-forward pulses. By supplying the control signal to the second drive circuit 30S, the second hand is adjusted to the current time (step S53 and S54).

On the other hand, the hour-and-minute counter circuit 95 counts the fast-forward pulses supplied from the drive controller circuit 24 to the hour-and-minute drive circuit 30HM by using the hour-and-minute location counter 86. When the counted value of the hour-and-minute location counter 86 matches the counted value of the hour-and-minute time counter 99, the hour-and-minute matching detecting circuit 87 generates a control signal to stop sending fast-forward pulses. By supplying the control signal to the hour-and-minute drive circuit 30HM, the hour hand and the minute hand is adjusted to the current time (step S53 and S54).

In this explanation, when switching to the display mode, the second hand is adjusted first, and then other hands are adjusted. However, this order is not limited to this. The hour hand and the minute hand can be adjusted first. Or the hour hand, the minute hand, and the second hand can be adjusted simultaneously. Then after the transition to the display mode which displays the current time, the normal hand movement is carried out and displaying the current time is continued (step S55).

In the above example, the operation of the time keeping apparatus according to the first embodiment, which comprises the carry-state detecting circuit 88 and the non-carry state measuring circuit 97 instead of the generation detecting circuit 91 and the non-generation time measuring circuit 84, is explained. However, the time keeping apparatus according to the second embodiment may comprise the carry-state detecting circuit 88 and the non-carry time measuring circuit 97 instead of the generation detecting circuit 91 and the non-generation time measuring circuit 84. In this case, as in the above example, the carry-state detecting circuit 88 judges whether the time keeping apparatus 1 is in a carry-state instead of the generation detecting circuit 91 which measures the amount of generation by the generating device 40 and judges whether or not the state of the generating device 40 is in the generating state.

Also using the carry-state detecting circuit 88 has other advantages. One of them is that when the circuit 88 is used with the solar cell 89, the mode transition becomes more natural to the user. This is because even in darkness the mode does not change to the power saving mode due to the carry-state. This is also because when the user stops carrying the apparatus, the apparatus stops displaying time and enters the power saving mode. For the carry-state circuit 88, an acceleration sensor for measuring an acceleration produced when the apparatus is carried, a measuring instrument for measuring a change in interelectrode resistance or interelectrode capacitance when the apparatus is carried, or a piezoelectric element can be used.

The countercurrent prevention diode 41 is used to prevent the stored charge in the battery 48 from flowing back.

In the second variation, when the carry-state circuit 88 detects a state of non-carrying, the operation mode is switched to the power saving mode and the power consumption can be more reduced.

[6.3] Third Variation

In the above embodiments, the receiver circuit 25 periodically receives the time data. However it is possible to use a configuration in which when the operation mode is switched from the display mode to the power saving mode, transition to the power saving mode is carried out after the receiving operation is conducted. By this, when the receiving operation is not conducted during the power saving mode and the operation mode is switched from the power saving mode to the display mode, it is possible to perform a time display more correctly.

[6.4] Fourth Variation

In the above embodiments, an electromagnetic induction type generator is used for the generator 40. However, other generation devices, for example, solar cell, thermoelectric element, or piezo-electric device can be used. Also it is possible to use more than two kinds of these generation devices in the generator 40.

[6.5] Fifth Variation

In the above embodiments, the rectifier circuit 47 can be a half-wave rectifier circuit or a full-wave rectifier circuit. Also the circuit 47 can be configured with diodes or active elements.

[6.6] Sixth Variation

In the above embodiments, as motors for driving the hands, the hour-and-minute motor for the hour hand and the minute hand, and the second motor for the second hand are used. However, configuration for the apparatus is not limited to this. For example, instead of using two motors, it is possible to use one motor that moves all three hands. Or it is also possible to use three motors for each of these three hands. Also it is possible use liquid crystal display (LCD) for second display and a motor for the hour hand and the minute hand. Also all the displays for time and calendar can be performed by using LCD.

[6.7] Seventh Variation

In the above embodiments, as an antenna for receiving the standard time radio wave, the ferrite rod antenna 26 is used. However when receiving FM radio wave with a frequency from 76 MHz to 108 MHz in which a time data is superimposed, it is possible to use a loop antenna or a ferrite rod antenna. Also when receiving a radio wave with a frequency of 1.5 GHz coming from the satellites for the Global Positioning system (GPS) in which a time data is superimposed, it is possible to use a microstrip antenna or a helical antenna.

As a radio wave in which a time data is superimposed, the standard time radio wave from the CRL Japan is used in the above embodiments. However, instead of using the radio wave from the CRL Japan, it is possible to use other signals such as the GPS signals, pager signals used in FLEX-TD pager system, FM multiplexed signal in which a time data is superimposed, and signals transmitted from the base stations to the digital mobile phone in the CDMA communications system.

[6.8] Eighth Variation

In the above embodiments, the large resistance resistor 39 is used to discharge the charge in the capacitor 38 in the generation detecting circuit 91. However, the resistor 39 is replaceable to a small constant current source with an ability of several nano amperes.

[6.9] Ninth Variation

In the above embodiments, based on the standard time radio wave in which a time information is superimposed, the time display of hour, minute, and second is automatically adjusted. However, in addition to these time displays, calendar display can be adjusted automatically. As explained above, the standard time radio wave has a date information in it. So by adding a motor for the calendar in addition to the motors for driving the second hands, the minute hand, and the hour hand, calendar display can be adjusted automatically. In this case, it is also possible to add a calendar display location element.

[7] Control Method of the Embodiments of the Present Invention

To sum up the control method of the embodiments of the present invention, in a method for controlling a time keeping apparatus which comprises a generator unit for generating electricity by converting external energy to electrical energy and a time display unit for performing a time display, the method carries out detecting a state of generation of the generator unit, outputting a detected generation state signal, switching an operation mode of the time display unit between a normal operation mode in which the time display is performed based on the detected generation state signal and a power saving mode in which the time display is stopped, a receiving step for receiving a time information from outside of the apparatus in a predetermined cycle during the power saving mode, renewing a current time information which corresponds to the current time by referring to the time information received by the receiver unit and switching a state of the time display unit from a time display stoppage state to a current time display state in which a current time is displayed based on the current time information when the operation mode is switched from the power saving mode to the normal operation mode. In this case, when the state of the generator unit is detected to be in a non-generation state on the basis of the detected generation state signal, the operation mode is switched from the normal operation mode to the power saving mode.

And the cycle of receiving the time information is longer in the power saving mode than in the normal operation mode.

And the receiver unit receives the time information when the operation mode is switched from the normal operation mode to the power saving mode.

And when the detected generation state signal has indicated that the generator unit has not been generating for more than a prescribed time period, a state of the generator unit is identified as in the non-generation state.

And the time display unit comprises a hand for displaying time, and the hand is not driven during the power saving mode and, the hands are driven to a location corresponding to the current time when switching to the current time display state.

When switching the operation mode from the normal operation mode to the power saving mode, the hands are moved to a prescribed location and then the operation mode is switched to the power saving mode, and when switching to the current time display state, the hands are driven from the prescribed location to a location corresponding to the current time.

And a counted value which corresponds to the number of drive pulses generated for driving the hand is output, the counted value is stored when the operation mode is switched from the normal operation mode to the power saving mode, and switching operation to the current time display state is controlled based on the counted value.

And hand locations are determined, the hands are driven to a location corresponding to the current time from the hand locations when switching to the current time display state.

And a state of generation is detected based on generated voltage by the generator unit.

And a battery voltage of the battery unit is determined, and receiving the time information is stopped when the battery voltage is lower than a prescribed voltage and the operation mode is in the power saving mode. Here, the prescribed voltage is set high enough for completion of receiving operation of the time information.

And detection whether or not the time keeping apparatus is in a carry-state is made based on the state of generation. And electricity is generated using external energy and is stored. And a time display is performed by using the electricity. And detection of a carry-state of the time keeping apparatus is made. And switch is performed of an operation mode of the time display unit between a normal operation mode in which the time display is performed and a power saving mode in which the time display is stopped. And receiving a time information from outside in a prescribed cycle carried out. And renewal is conducted of a current time information by referring to the time which corresponds to the time information received. And when the operation mode is switched from the power saving mode to the normal operation mode, based on the current time information, switch is conducted of a state of the time display unit from a time display stoppage state to a current time display state in which a current time is displayed. In this case, when a prescribed non-carry-state is detected, the operation mode is switched from the normal operation mode to the power saving mode.

What is claimed is:

1. A time keeping apparatus comprising:

a generator unit that generates electricity using external energy;

a storage unit that stores the electricity;

a time display unit that displays time by using the electricity supplied from the storage unit;

a generation state detecting unit that detects an operation state of the generator unit and that outputs a detected generation state signal;

a mode switching unit that, responsive to the detected generation state signal, switches an operation mode of the time display unit between a normal operation mode in which the time display operation is performed and a power saving mode in which the time display operation is stopped;

a receiver unit for receiving external time information during the normal operation mode and the power saving mode; and a current time counting unit that updates current time information by referring to the time that corresponds to the time information received by the receiver unit; and, wherein the mode switching unit is responsive to the detected generation signal to switch the operation mode from the normal operation mode to the power saving mode when the state of the generator unit is detected to be in a non-generation state.

2. A time keeping apparatus of claim 1, wherein the time display unit comprises an electro-optical display for displaying a time; and at least a part of the time is not displayed on the electro-optical display during the power saving mode, and the at least the part of the time is restarted to be displayed when the operation mode is switched from the power saving mode to the normal operation mode.

3. A time keeping apparatus of claim 1, wherein a time interval between receptions of two successive pieces of external time information in the power saving mode is longer than that in the normal operation mode.

4. A time keeping apparatus of claim 1, wherein the receiver unit receives the time information when the operation mode is switched from the normal operation mode to the power saving mode.

5. A time keeping apparatus of claim 1, wherein when the detected generation state signal has indicated that the generator unit has not been generating for more than a prescribed time period, the mode switching unit determines a state of the generator unit as in the non-generation state.

6. A time keeping apparatus of claim 1, further comprising:

a current time display switching unit that is responsive to the operation mode switching from the power saving mode to the normal operation mode to switch a state of the time display unit from a time display stoppage state to a current time display state in which a current time is displayed, based on the current time information; and wherein the time display unit comprises at least one hand for displaying time; and wherein the at least one hand is not driven during the power saving mode; and, the current time display switching unit drives the at least one hand to a location corresponding to the current time when switching to the current time display state.

7. A time keeping apparatus of claim 5, wherein the at least one hand moves to a prescribed location before the mode switching unit switches the operation mode from the normal operation mode to the power saving mode; and, the current time display switching unit drives the hands from the prescribed location to a location corresponding to the current time when switching to the current time display state.

8. A time keeping apparatus of claim 6, further comprising:

a hand location counter that outputs a counted value that corresponds to the number of drive pulses generated for driving the at least one hand; and, a nonvolatile memory for storing the counted value when the operation mode is switched from the normal operation mode to the power saving mode;

wherein the current time display switching unit controls switching operation to the current time display state based on the counted value.

9. A time keeping apparatus of claim 6, further comprising a hand location determination unit for determining the at least one hand location; and wherein the current time display switching unit drives the at least one hand to a location corresponding to the current time from the hand location determined by the hand location determination unit when switching to the current time display state.

10. A time keeping apparatus of claim 1, wherein the generator unit comprises a solar cell.

11. A time keeping apparatus of claim 10, further comprising a voltage determining unit that determines a storage voltage of the storage unit, and wherein the receiver unit stops receiving the time information when the storage voltage is lower than a prescribed voltage and the operation mode is in the power saving mode.

12. A time keeping apparatus of claim 11, wherein the prescribed voltage is set to a value such that the receiver unit can complete receiving the time information.

13. A time keeping apparatus of claim 10, further comprising a carry-state detecting circuit for detecting whether or not the apparatus is in a carry-state.

14. A time keeping apparatus of claim 1, wherein the generator unit comprises an oscillating weight and a rotor, and that generates electricity by using rotation of the rotor that is driven by movement of the oscillating weight.

15. A time keeping apparatus of claim 14, wherein the generation state detecting unit detects a state of generation based on voltage generated by the generator unit.

16. A time keeping apparatus of claim 1, wherein the generator unit comprises a thermoelectric generator that generates electricity by using thermal energy.

17. A time keeping apparatus comprising:

a storage unit that stores electricity;

a time display unit that displays time by using the electricity supplied from the storage unit;

a carry-state detecting unit that detects a carry-state of the time keeping apparatus and that outputs a detected carry-state signal;

a mode switching unit that, responsive to the detected carry-state signal, switches an operation mode of the time display unit between a normal operation mode in which the time display operation is performed and a power saving mode in which the time display operation is stopped;

a receiver unit that receives external time information during the normal operation mode and the power saving mode; and a current time counting unit for updating current time information by referring to the time which corresponds to the time information received by the receiver unit;

wherein the mode switching unit is responsive to the detected carry-state signal to switch the operation mode from the normal operation mode to the power saving mode when the carry-state of the time keeping apparatus is detected to be in a non-carried state.

18. A time keeping apparatus of claim 17, wherein the time display unit comprises an electro-optical display for displaying a time; and at least a part of the time is not displayed on the electro-optical display during the power saving mode, and the at least the part of the time is restarted to be displayed when the operation mode is switched from the power saving mode to the normal operation mode.

19. A time keeping apparatus of claim 17, wherein a time interval between receptions of two successive pieces of external time information in the power saving mode is longer than that in the normal operation mode.

20. A method for controlling a time keeping apparatus that comprises a generator unit that generates electricity by converting external energy to electrical energy and a time display unit that performs a time display, the method comprising:

detecting an operation state of the generator unit and outputting a detected generation state signal;

in response to the detected generation state signal, switching an operation mode of the time display unit between a normal operation mode in which the time display is performed and a power saving mode in which the time display is stopped;

receiving external time information during the normal operation mode and the power saving mode;

updating a current time information that corresponds to the current time by referring to the received external time information; and responsive to the detected generation state signal, switching the operation mode from the normal operation mode to the power saving mode when the state of the generator unit is detected to be in a non-generation state.

21. A method for controlling a time keeping apparatus of claim 20, wherein the time display unit comprises an electro-optical display for displaying a time; and at least a part of the time is not displayed on the electro-optical display during the power saving mode, and the at least the part of the time is restarted to be displayed when the operation mode is switched from the power saving mode to the normal operation mode.

22. A method for controlling a time keeping apparatus of claim 20, wherein a time interval between receptions of two successive pieces of external time information in the power saving mode is longer than that in the normal operation mode.

23. A method for controlling a time keeping apparatus that comprises a time display unit that performs a time display, the method comprising:

detecting a carry-state of the time keeping apparatus and outputting a detected carry-state signal;

in response to the detected carry-state signal, switching an operation mode of the time display unit between a normal operation mode in which the time display is performed and a power saving mode in which the time display is stopped;

receiving external time information during the normal operation mode and the power saving mode;

updating a current time information that corresponds to the current time by referring to the received external time information; and responsive to the detected carry-state signal, switching the operation mode from the normal operation mode to the power saving mode when the state of the time keeping apparatus is detected to be in a non-carried state.

24. A method for controlling a time keeping apparatus of claim 18, wherein the time display unit comprises an electro-optical display for displaying a time; and at least a part of the time is not displayed on the electro-optical display during the power saving mode, and the at least the part of the time is restarted to be displayed when the operation mode is switched from the power saving mode to the normal operation mode.

25. A method for controlling a time keeping apparatus of claim 17, wherein a time interval between receptions of two successive pieces of external time information in the power saving mode is longer than that in the normal operation mode.

* * * * *

UNITED STATES PATENT AND TRADEMARK OFFICE

CERTIFICATE OF CORRECTION

PATENT NO. : 7,102,964 B2
APPLICATION NO. : 10/851435
DATED : September 5, 2006
INVENTOR(S) : Teruhiko Fujisawa It is certified that error appears in the above-identified patent and that said Letters Patent is hereby corrected as shown below:

Title page,

Item [30], Foreign Application Priority Data,

Please insert:

--Feb. 10, 2000 JP.....2000-033809

Dec. 25, 2000 JP.....2000-393635--.

Signed and Sealed this

Twenty-sixth Day of December, 2006

JON W. DUDAS
*Director of the United States Patent and Trademark Office*